United States Patent [19]

Glanz

[11] 4,291,825

[45] Sep. 29, 1981

[54] WEB GUIDING SYSTEM

[75] Inventor: Richard Glanz, Crystal Lake, Ill.

[73] Assignee: Baldwin-Korthe Web Controls, Inc., Addison, Ill.

[21] Appl. No.: 31,393

[22] Filed: Apr. 19, 1979

[51] Int. Cl.[3] ..... B65H 25/26; G01N 21/86; G01V 9/04

[52] U.S. Cl. ..... 226/18; 250/559; 250/571

[58] Field of Search ..... 226/18, 20; 250/559, 250/561, 548, 571; 242/57.1

[56] References Cited

U.S. PATENT DOCUMENTS

| | | | |
|---|---|---|---|
| 2,797,091 | 6/1957 | Fife | 226/22 |
| 3,204,109 | 8/1965 | Goodwin | 226/20 |
| 3,373,288 | 3/1968 | Otepka et al. | 250/548 |
| 3,615,048 | 10/1971 | Martin | 226/20 |
| 3,966,105 | 6/1976 | Curran | 226/21 |
| 4,003,511 | 1/1977 | Schwestka | 226/3 |
| 4,069,959 | 1/1978 | Bartell et al. | 226/21 |
| 4,077,579 | 3/1978 | Seleskie et al. | 242/57.1 |
| 4,146,797 | 3/1979 | Nakagawa | 250/548 |

FOREIGN PATENT DOCUMENTS

| | | | |
|---|---|---|---|
| 7337532 | 3/1974 | Fed. Rep. of Germany . | |
| 2449171 | 4/1976 | Fed. Rep. of Germany . | |
| 2712295 | 10/1977 | Fed. Rep. of Germany . | |
| 2632272 | 1/1978 | Fed. Rep. of Germany . | |
| 54-125364 | 9/1979 | Japan | 226/20 |

OTHER PUBLICATIONS

Elektronik, vol. 21, No. 6, 1972, Munchen, "Ein Optisches Wegmesgerat", G. Fritz, pp. 191-194.

*Primary Examiner*—Leonard D. Christian
*Attorney, Agent, or Firm*—Neuman, Williams, Anderson & Olson

[57] ABSTRACT

A system for positioning a web of material as it enters and passes through a course for treating the web, as in a printing press, is disclosed. The edges of the web are scanned by infrared sensing devices which are connected by various electrical circuits to a tilt mechanism contacting the web, and both the scanning devices and the tilt mechanism may be synchronized, or manually controlled, to direct the web through the press. A broad diameter channel of infrared radiation is utilized in the scanners. The relationship of the web to its desired path and the correcting actions of the system may be continuously read in terms of actual deviation changes on a display panel. The tilt rollers and the scanners may be automatically centered on a fixed reference point in preparing the web for its course through the press. The system includes correlation of the tramming of the tilt rollers to continued position sensing of the web by the infrared scanners.

45 Claims, 13 Drawing Figures

FIG. 1
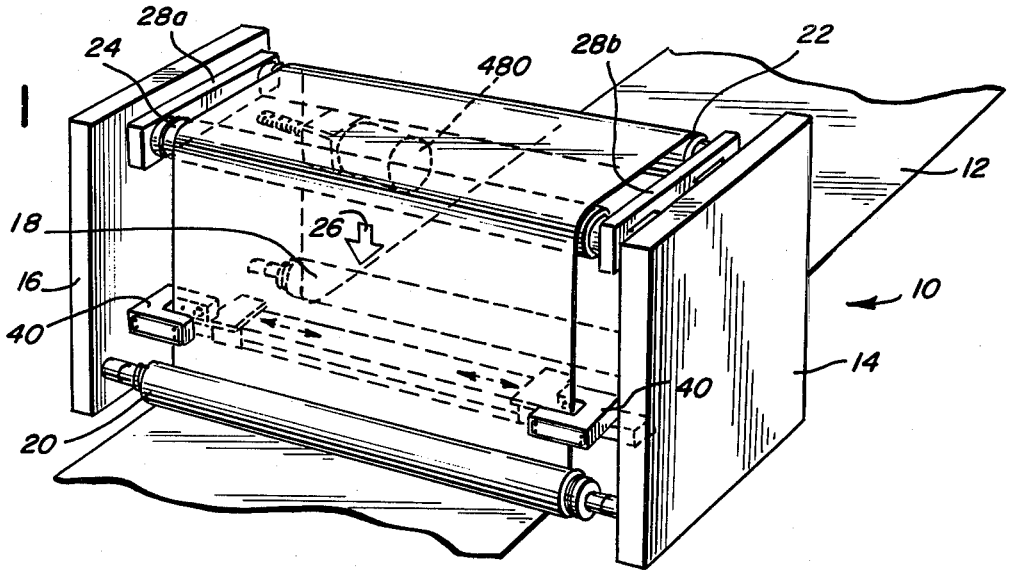
FIG. 2
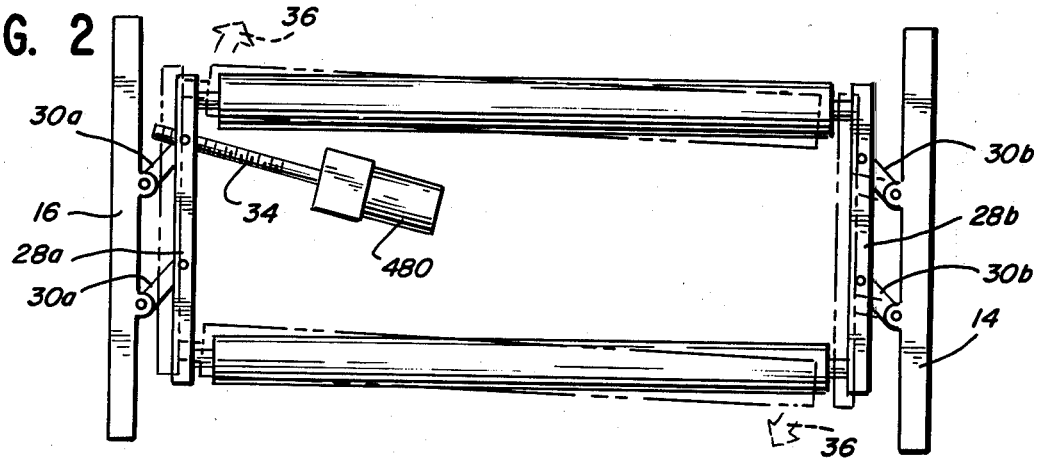
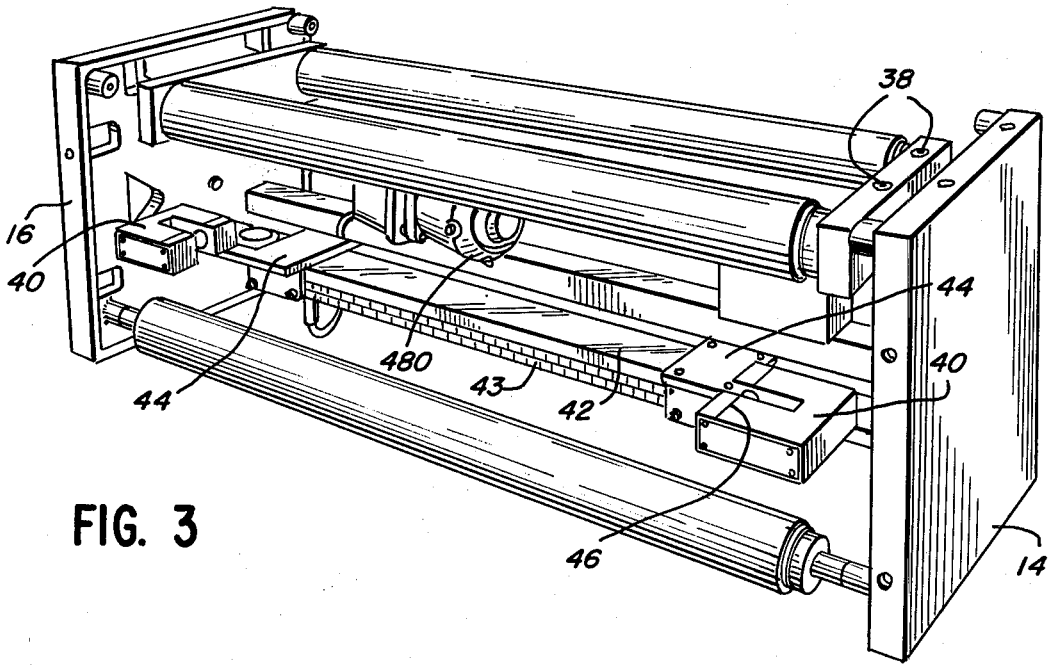
FIG. 3

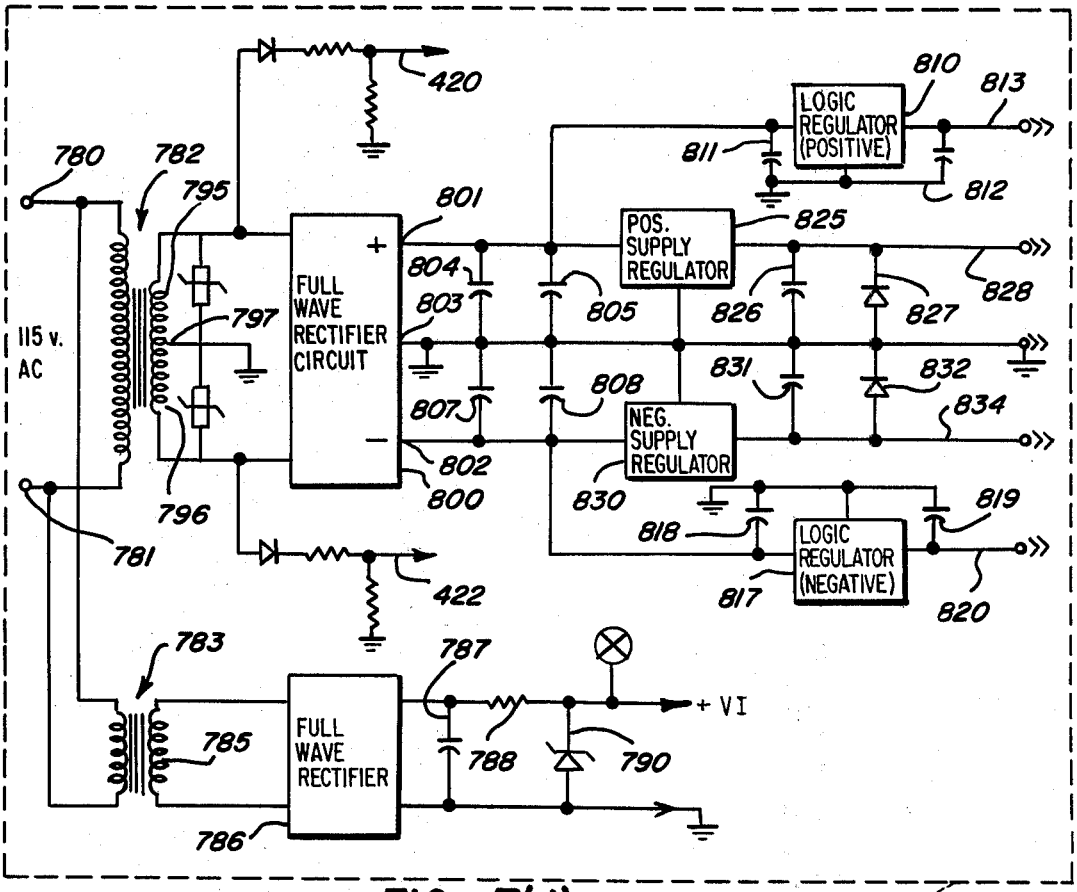
FIG. 7(d)
MAIN POWER SUPPLY CKT.
FIG. 7(e)
SCAN MOTOR SWITCHING CKT.
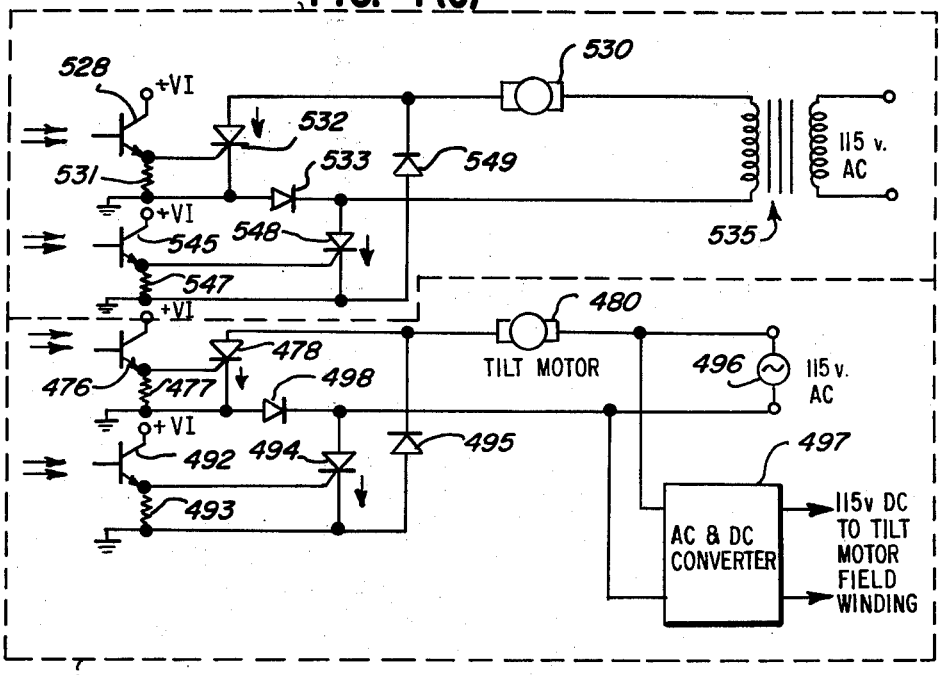
TILT MOTOR SWITCHING CKT.

WEB GUIDING SYSTEM

This invention relates to a web guiding system utilizing a tilt mechanism for controlling the course of a web, as through a printing press. More particularly, it relates to a system utilizing one or more infrared scanner mechanisms having large diameter focused web-detecting beams disposed along the edge of the web to accomplish accurate, continuous control of the motion of the tilt mechanism, a read-out of the position of the web, as it is moving, in terms of actual measurements of deviation, if any, from the desired web path, automatic centering of the tilt mechanism and the scanner mechanism before the web begins its course, continuous, automatic maintenance of the position of the web in relation to a preselected reference point during movement of the web along its course, and maintenance of a taut web edge passing through the scanner beams to avoid false position readings by the scanners.

Web positioning systems are widely used in the printing of newspapers, magazines, cloth materials or the like to provide an operator with accurate control of the side-to-side web position for its passage through the press. Rollers positioned across the web, whose positions can be somewhat shifted or "tilted", have been used, as in U.S. Pat. No. 2,797,091 to Fife, and photosensitive sensors for detecting variations in the web edge positions have also been used, as in U.S. Pat. No. 3,204,109 to Goodwin. Otepka U.S. Pat. No. 3,373,288, discloses a system in which multiple rollers, including "tilt" rollers, are shifted at angles with respect to each other in a horizontal plane in order to warp the path of the web and thereby change its lateral position in response to optical sensors which operate in a differential mode. The web guiding system of the present invention is similarly controlled. However, prior known web guiding systems have had several drawbacks. The optical sensors have been adversely affected by changes in the ambient light conditions and in particular by fluorescent lighting being used in the location of the printing press. A change in light conditions could typically cause a movement of the web to one side or the other by as much as several thousandths of an inch.

Additionally, the prior known web positioning systems have not provided an accurate display of web deviation to the operator which could serve as a guide in maintaining web position deviations from the norm, as may be desired for special printing applications. The only web position indicators seen on prior machines have been crude needle indicators which gave little or no indication of actual web deviation in a meaningful numerical fashion. Finally, the prior known systems have required substantial effort and set-up time for centering the tilt roller mechanism at the beginning of a printing operation and adjusting the separation and location of the edge detecting sensors prior to start-up.

The present invention overcomes these and other drawbacks and deficiencies of the prior web guiding systems and provides new and additional features not heretofore available in edge guided web control systems. One principal advance is the use of infrared rays which are too long to be seen by the human eye and are in the range of about 840 to 1040 angstroms. As will be seen, the preferred form of the present system is designed to operate within a portion of this range.

Accordingly, it is a object of the present invention to provide a web guiding system incorporating infrared radiation emitters to scan the edges of a web moving through a press.

It is another object of the present invention to provide a web guiding system incorporating an optical mechanism creating a broad channel of infrared radiation directed at the edge of a moving web running through a press, whereby the channel spans the expected path of any web deviations from a desired web path.

It is another object of the present invention to provide a web guiding system incorporating a photo-transistor to receive such portion of an infrared beam as passes the edge of a moving web and thereby transmit a continuous output signal identifying the position of the web along a preselected path.

It is another object of the present invention to provide a web guiding system utilizing web edge scanners which are unaffected by fluorescent light or other extraneous light in the vicinity of the web which is not substantially in the infrared range.

It is another object of the present invention to provide a web guiding system incorporating a digital readout display panel reflecting actual measurements of corrections being made to the position of a moving web by a system of tilt rollers disposed in the web path.

It is another object of the present invention to provide a web guiding system incorporating circuitry whereby the web edge scanners and the tilt rollers may be simultaneously and automatically aligned during an initial set-up of the web before sending it on its course through a press.

It is yet another object of the present invention to provide a web guiding system utilizing an infrared scanner on each edge of the web operatively oriented to move in unison with each other and maintain movement of the center of the web along a preselected path.

It is still another object of the present invention to provide a web guiding system utilizing an infrared scanner for reading a taut web edge.

These and yet additional objects and features of the invention will become apparent from the following detailed discussion of an exemplary embodiment, and from the drawings and appended claims.

In a preferred form of the present invention, a web control assembly for a web is provided comprising an entrance roller, a pair of tilt rollers mounted on a tilt frame, and an exit roller, the web being disposed under the entrance roller, over the tilt rollers and under the exit roller. There is a motor means connected to the tilt frame operable to move the frame to cant the tilt rollers with respect to the longitudinal line of travel of the web. A web edge scanner adjacent at least one edge of the web includes a source of radiation in the infrared range, focus means for guiding said radiation into a channel having a width encompassing the range of normal web edge deviation from a desired path along the longitudinal lines of travel of the web, and signal means spaced from said focus means for receiving said radiation and producing a continuous output signal corresponding to the magnitude of said radiation passing the edge of the web. Means are provided intermediate the motor means and the scanner for directing the motor means to cant and straighten the tilt frame.

BRIEF DESCRIPTION OF THE DRAWINGS

For a complete understanding of this invention, reference should be made to the accompanying drawings in which:

FIG. 1 is a perspective view of a web control assembly showing a web threaded therethrough;

FIG. 2 is a top plan view of the assembly shown in FIG. 1 diagramatically illustrating in dotted lines the positions to which the uppermost rollers and frame portions in FIG. 1 may be moved;

FIG. 3 is an enlarged view of the assembly in FIG. 1, in perspective, without the web;

FIG. 4(*b*) is a enlarged sectional view of the scanner shown in FIG. 4(*a*), taken along the line 4(*b*)—4(*b*) in FIG. 4(*a*), showing an infrared radiation emitter and an infrared radiation receiver;

FIG. 7(*b*) is a diagrammatic representation of the mode selection logic circuits and indicators utilized in the present invention;

FIG. 7(*c*) is a diagrammatic representation of the failure detection, scan motor drive logic and motor drive logic circuits utilized in the present invention;

FIG. 7(*d*) is a wiring schematic, partially in block form, of the power supply for the control circuit utilized in the present invention;

FIG. 7(*e*) is a diagrammatic representation of the scan motor and tilt motor switching circuits utilized in the present invention.

DETAILED DESCRIPTION OF THE PREFERRED EMBODIMENT

Figure 4A:
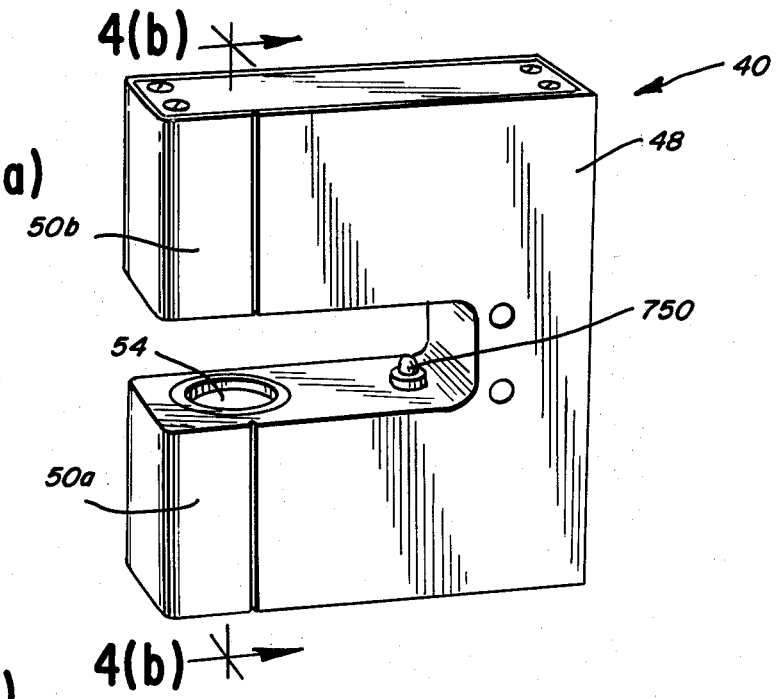
FIG. 4(*a*) is an enlarged, perspective view of one of the scanners shown in FIG. 3, with the orientation of the scanner slightly changed on the page for convenience of illustration.

Considering first FIGS. 1–5, a tilt mechanism 10, through which a web 12 to be processed is threaded, incorporates a gear edge plate 14 and an operator edge plate 16. The terms "gear" and "operator" are normally used, and are used herein, to designate particular sides of a press, the "operator" side being where the operator normally works, and the "gear" side being where the press drive mechanism is normally located. An entrance idler roller 18 is journalled into the edge plates, as is exit idler roller 20. Above the idler rollers 18 and 20 are first and second tilt rollers 22 and 24, respectively. The web 12, mounted to move through the tilt mechanism 10 in the direction of arrow 26, is threaded beneath the entrance, or inlet, idler roller, over the first and second tilt rollers and under the exit, or outlet, idler roller 20.

Both tilt rollers are mounted in a tilt frame which includes tilt roller support members 28*a* and 28*b*. Each support member is connected to its nearest edge plate by mounting links, member 28*b* being connected to edge plate 14 by links 30*b* and member 28*a* being connected to edge plate 16 by links 30*a*. Tilt motor 480, which is connected by a screw drive mechanism 34 to support member 28*a*, is operable to move the tilt roller support members and the tilt rollers themselves to the dotted line positions indicated by the arrows 36 in FIG. 2. The tilt rollers may then be canted and straightened with respect to the path of the web by energizing the tilt motor 480. Due to the bearing forces of the web on the energized tilt rollers, the longitudinal path of the web may be warped and thus bring the path of a moving web back into proper line in the press.

The mechanical arrangements above may be examined in greater detail in the aforesaid U.S. Pat. No. 3,373,288 to Otepka. The electrical circuitry by which the various operations of the present invention may be accomplished will be discussed in greater detail hereinafter. It is noteworthy, however, that the foregoing discussion of the disposition of the tilt frame and idler rollers between the edge plates may implicitly include an assembly in which the edge plates need not be separately defined plates and may instead be integral portions of the side walls of a press. Similarly, the idler rollers need not be manufactured as an integral part of the tilt mechanism in the over-all web control assembly but may be supplied at the time that the tilt frame is installed between the edge plates, or between the press side walls, as the case may be.

It is important that all of the rollers in the press be trammed with each other, and accordingly in the tilt mechanism 10 the exit idler roller 20 is trammed with tilt roller 24 in a manner which will now be discussed. In like manner, entrance idler roller 18 is trammed with tilt roller 22. First, a ground plain is established by laying a parallel, a precision ground instrument, across the entrance and exit idler rollers 18 and 20. Using a height gauge to take a measurement from the top surface of an idler roller to the top surface of a tilt roller, a reference dimension is established at the end of the rollers adjacent the operative edge plate 16 (also known as the yoke side). Next, the same height measuring procedure is adopted to determine, at the other end of the rollers adjacent the opposite edge plate 14, the distance from the top surface of the ilder rollers to the top surface of the tilt rollers. The two height dimensions which are thus determined at opposite ends of the tilt rollers should match within 0.005 inch in order to achieve even progression of the web through the mechanism.

To change a height dimension, adjustable members such as tramming adjustment screws 38 may be turned, as needed, as by using an Allen wrench. The turning of these screws varies the height relationship between the support member 28*b* in the tilt frame in which the tilt rollers 22 and 24 are disposed and the edge plate 14 in which the idler rollers 18 and 20 are disposed. The height adjustment between the support member and the edge plate is accomplished by moving pivotal bearing members (not shown) for the links 30*b*. Said bearing members, in which the ends of links 30*b* are held in the support member 28*b*, are disposed against upper (shown) and lower (not shown) tramming adjustment screws 38. When the upper and lower adjustment screws 38 are compensatingly rotated, one up and the other down, the bearing members are caused to move upwardly or downwardly as desired in order to move the support member 28*b* and thus tram the individual tilt rollers with the entrance and exit rollers.

The tramming of the tilt mechanism is especially important in connection with the use of the present invention. Due to the continuous observation of the web edges by the web edge scanners, which will soon be discussed, the web edges must remain taut. Without tramming the tilt mechanism, one of the web edges could be noticeably taut, and one could be quite loose, i.e., baggy or fluttering. Such slack in one edge of the web would be "read" as a change of web position by the scanner, thus causing the tilt mechanism to reorient the direction of the path of the web when no such reorientation was actually necessary or desirable.

A web edge position sensing mechanism, or scanner head, 40 is preferably disposed about each edge of web 12. While various materials can be expected to have somewhat variable widths, the scanners of the present invention are constructed to provide a scanning range which will encompass the normal amount of web edge deviation from a nominal uniform width in the type of stock to be handled. As shown in FIGS. 1 and 3, the scanner heads are mounted on a motorized, movable scanner bar 42 via mounting assemblies 44 intermediate the edge plates 14 and 16. The mounting assemblies are initially moved manually along the scanner bar 42 to space the scanner heads at opposite edges of the web width. Then the mounting assemblies are fixed in place, as by a cam mechanism (not shown). If the operator so desires, he may use the scale 43 on the face of the scanner bar to estimate the locations of the scanner heads.

When both of the scanner heads are fixed in place in this manner, they may be moved, as will be discussed more fully hereinafter, back and forth in unison in a horizontal direction by the scanner bar 42 the latter being moved like a sleeve by a scanner motor along a scanner mounting bar (not visible) extending between edge plates 14 and 16. Each scanner head is provided with an external alignment gauge 46 by which the head may be lined up visually, if desired, with a web edge.

As will become evident hereinafter, certain modes of operation of the present invention require the use of a scanner head at each edge of the web, but other modes only need one head, and accordingly the web guide system herein is not limited to the use of two scanner heads.

Figure 4B:
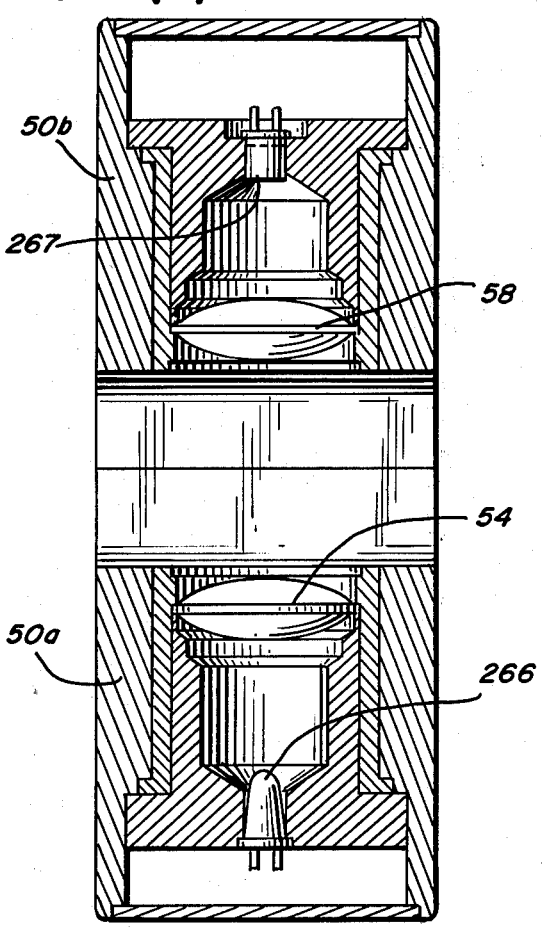
Figure 5:
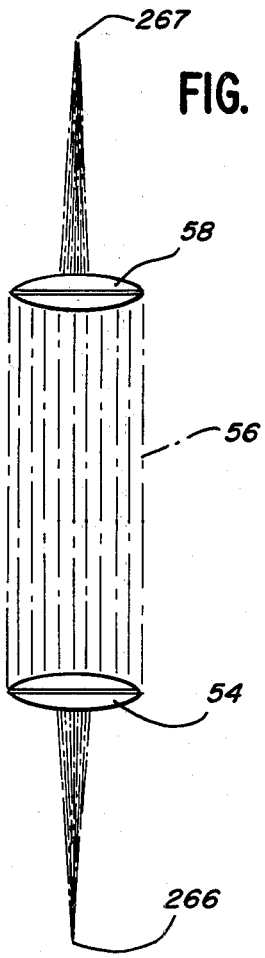
FIG. 5 is a diagrammatic view on a slightly enlarged scale, showing the focusing of infrared rays in the optical arrangement of emitter and receiver shown in FIG. 4(*b*)

Each scanner head 40 is constructed as shown in FIGS. 4(*a*), 4(*b*) and 5. The head includes a generally C-shaped body 48 having arm portions 50*a* and 50*b*. In one of the arms, 50*a*, there is a source of radiation 266 emiting rays in the infrared range. Also in arm 50*a* is a lens 54, which is part of an optical expanding system, to focus the infrared rays into a channel 56 (see FIG. 5) having a width which will encompass the normal range of web edge deviation from a desired, or preselected, web path. In the other arm 50*b* of the scanner head is a lens 58 to collect such portion of the infrared rays as pass the edge of a web extending between the arms. The lens 58 forms part of a signal means in the arm 50*b* which receives the infrared radiation and produces a continuous output signal corresponding to the magnitude of the infrared radiation received in lens 58. An additional member of the signal means is the phototransistor 267 which will be discussed shortly. A warning light 750 not in the infrared range may be mounted on the scanner head 40 to stay lit while infrared source 266 is operating, but go out when there is an infrared emitter failure.

It has been found that one desirable arrangement is to dispose the point source of infrared radiation at 0.825 inches from lens 54, the lenses being spaced apart 1.250 inches from each other with the web half-way in between, and the receiving lens 58 being disposed at 0.825 inches from the phototransistor 267. Such an arrangement is illustrated schematically in FIG. 5.

Figure 6:
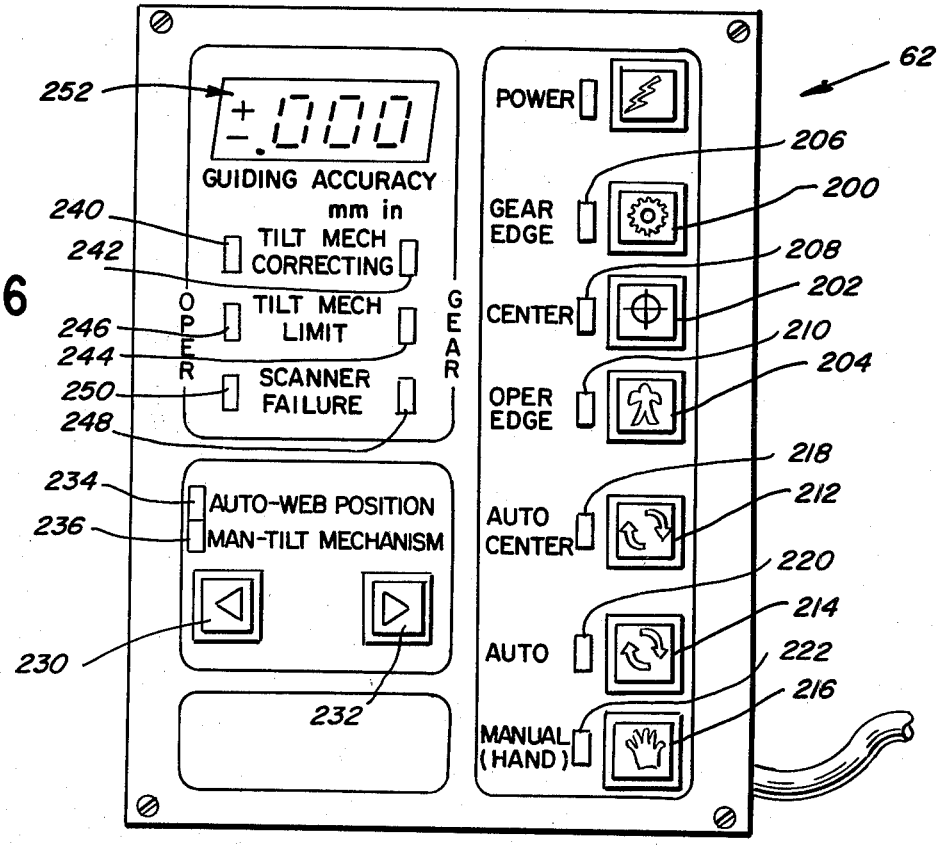
FIG. 6 is a view of a control panel incorporating signal lights, push button switches and operator instructions utilized in selecting and controlling operation of the control assembly shown in FIG. 1.

Each of the scanner heads and tilt mechanism are preferably operated from a central source, namely, a control panel as shown in FIG. 6. The system of the present invention is most versatile in controlling the course of a web, and in preface to a detailed discussion may be summarized as follows as to its operation.

The system operates to control the course of the web either automatically or manually. Normally the system is set up to run automatically, and accordingly an operator, once he has manually set the scanner heads to approximately the planned web width, and fastened each of them in place with their cam mechanisms, depresses the AUTO CENTER mode, button 212 on control panel 62. The effect is to move the motorized scanner bar to line up both scanner heads 40 to a central reference point, usually the center line of the press, so that they are arranged over the edges of the web at approximately the midpoint of their horizontal travelling range. Also, the tilt mechanism is simultaneously and automatically moved to a location in approximately the midpoint of its mechanical travel. This orientation of parts permits maximum latitude for automatic web guidance correction.

The system automatically enters into the AUTO MODE from the AUTO CENTER set-up position. The operator may elect to let the system operate in any of three sub-modes, i.e., the GEAR EDGE submode, the CENTER submode, or the OPERATOR EDGE submode. Either of the edge submodes controls the course of the web according to the scanner at the edge chosen, and the CENTER submode directs the course of the web according to a central reference point between the scanners. In any one of these three submodes, however, the operator may shift the reference of the scanners if he wants to for a short time.

In addition to the AUTO CENTER set-up position, the web control system may be set up manually before it is put into operation. Then the operator may elect to run the system automatically, or he may elect to run it manually. In either manual or automatic operation, the scanners provide, through the circuitry and apparatus about to be described, a visual read-out of the web position.

Figure 7A:
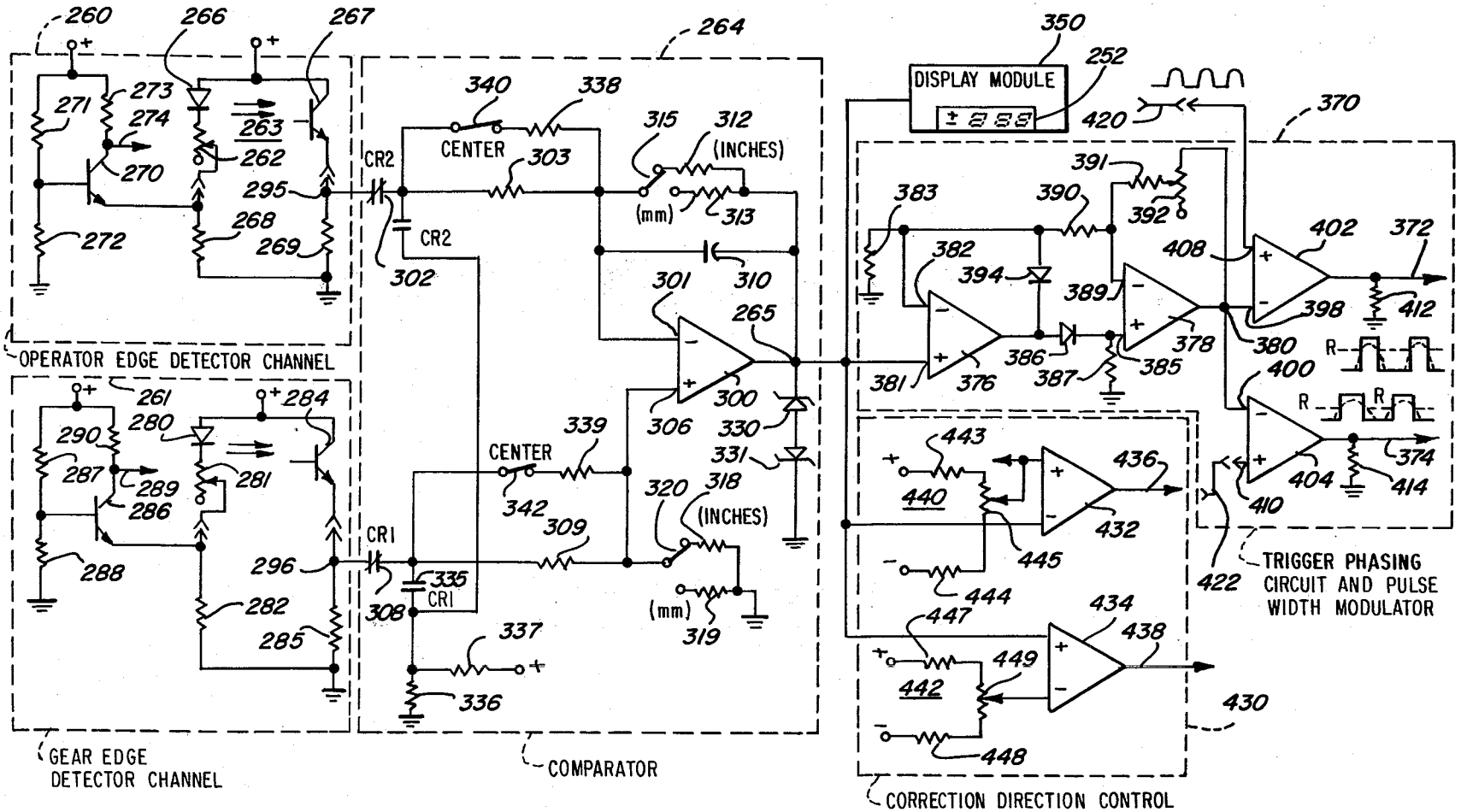
FIG. 7(*a*) is a diagrammatic representation of the automatic sensing, display and correction circuits utilized in the present invention.
Figure 7B:
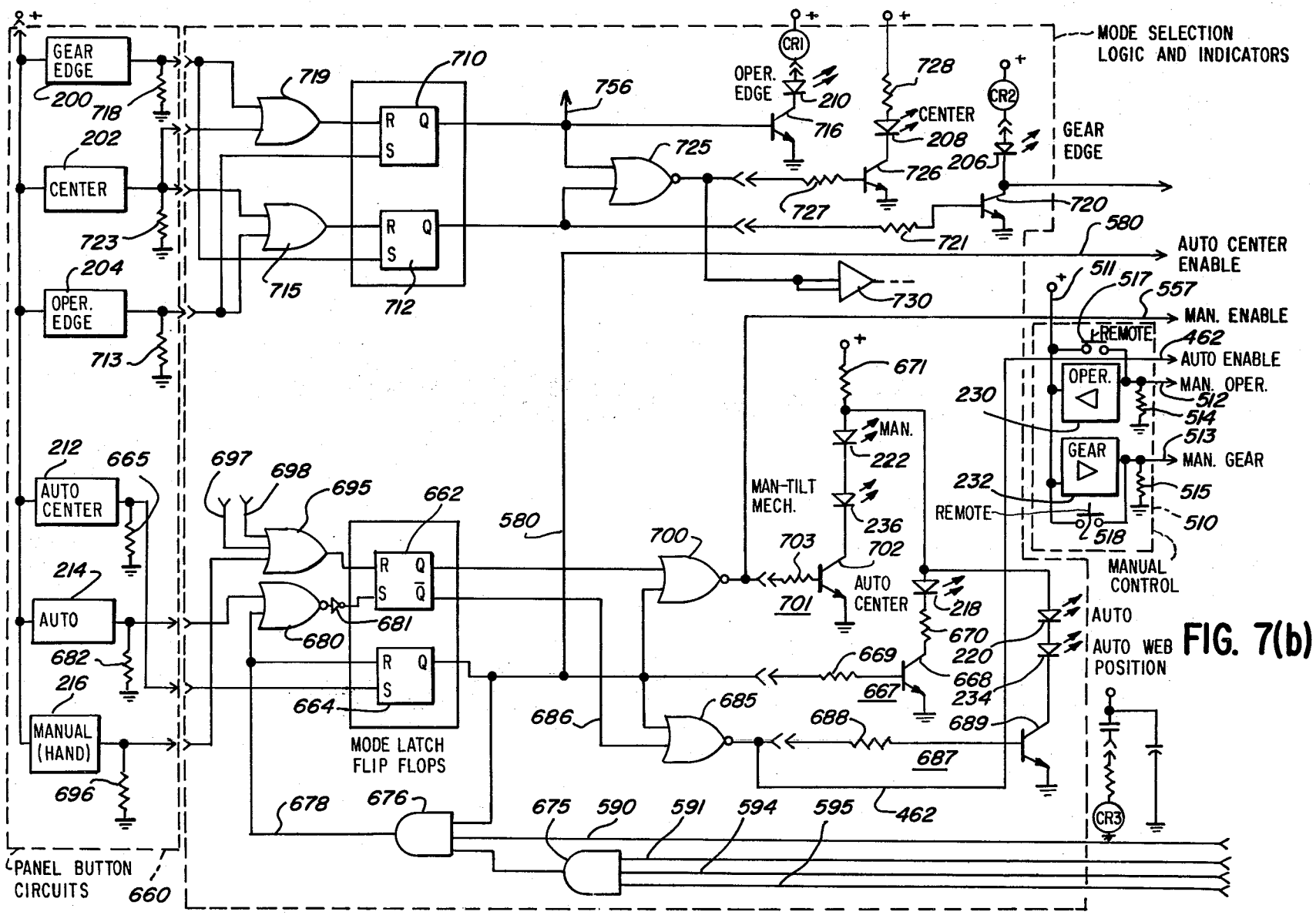
Figure 7C:
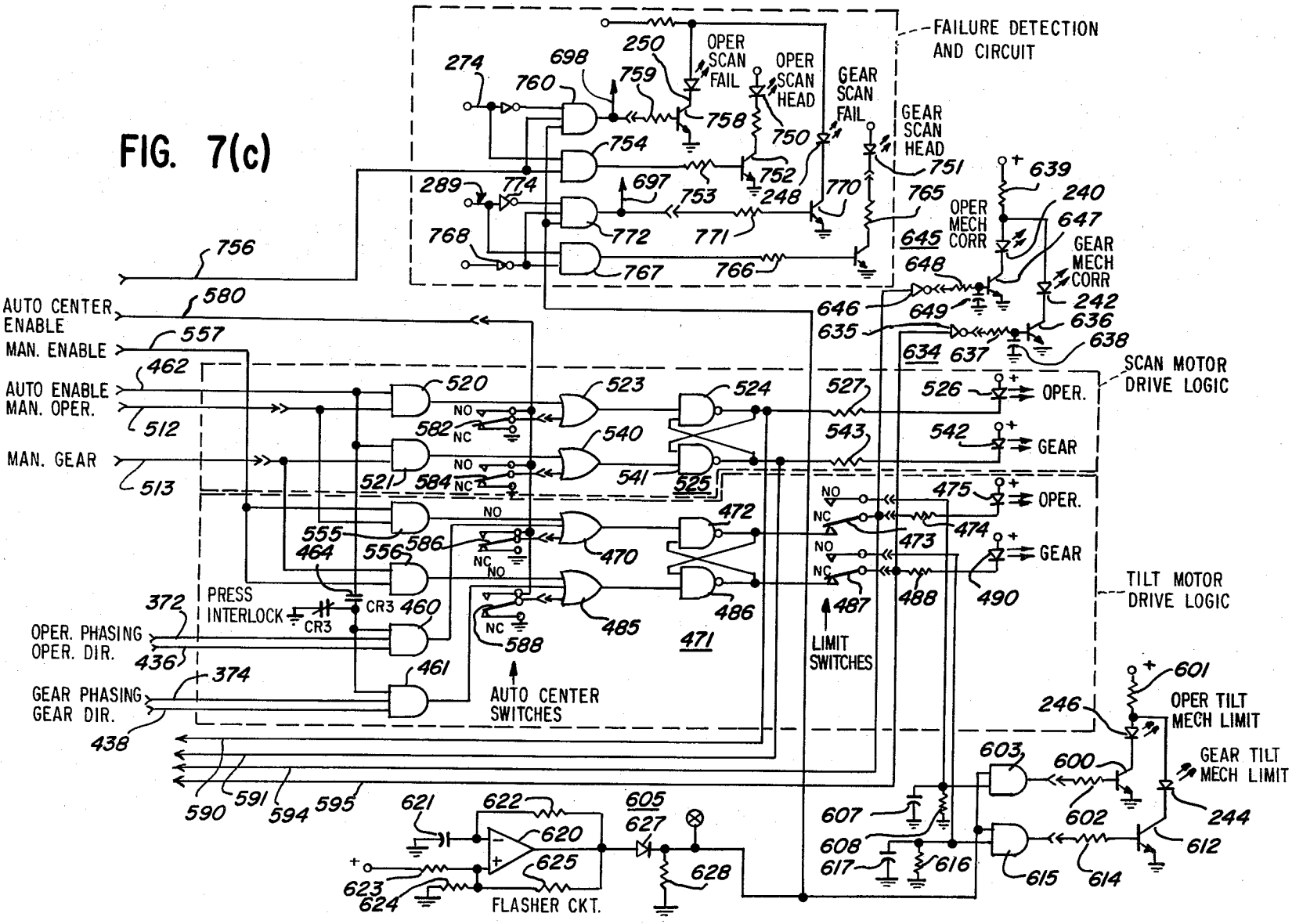

The control system includes not only control panel 62 shown in FIG. 6, but also a plurality of functional control circuits that operate in conjunction with the control panel and the various sensors, position and limit switches and other devices that control the scanner and tilt motors during the functional modes and submodes selected on the control panel. These circuits are shown in FIGS. 7(*a*), 7(*b*), 7(*c*), 7(*d*), and 7(*e*).

Turning first to the control panel and the functional modes available to the operator, the choice of operating modes is accomplished by a series of three pushbuttons 212, 214 and 216 designated AUTO CENTER, AUTO and MANUAL respectively. A series of indicator lights 218, 220 and 222 are adjacent the buttons 212, 214 and 216 respectively and are provided to signal the operator when the system is operating in each of the designated modes.

The AUTO CENTER mode is used to align the tilt mechanism and scanner heads with a desired central reference position prior to passing the web through the rollers. As will be described below, motors automatically drive the web tilt and scanner mechanisms to their center positions during operation in this mode.

The MANUAL mode selected by depression of the pushbutton 216 allows the operator to take manual control of the web tilt mechanism if he prefers a position for the web other than that created by the automatic centering system or the position prevalent at the time the system is activated. A pair of panel pushbuttons 230 and 232 are provided to allow the operator to adjust the tilt mechanism toward the operator or gear side of the press, respectively. An indicator light 236 designated MAN-TILT MECHANISM advises the operator during the MANUAL mode that the pushbuttons 230 and 232 are available for shifting the tilt mechanism, and hence the web. The position of the web relative to the reference position can be continuously monitored on an output indicator 252.

The AUTO mode selected by the pushbutton 214 is the principal system operating mode, and it provides for guiding of the web automatically in accordance with its position relative to one or more of the optical scanners 40 provided on the scanner carriage mechanism shown in FIGS. 1 and 3.

The choice of guiding the web based on its position relative to either one or both of the optical scanners 40 during the AUTO mode is also made by the operator from the control panel. To this end, three pushbuttons 200, 202 and 204 are located in the upper right hand quadrant of the control panel and designated GEAR EDGE, CENTER, and OPER. EDGE respectively. Adjacent these three pushbuttons are corresponding lights 206, 208 and 210 which are illuminated to indicate the edge control submode being used. As described in further detail below, the momentary depression of the button 200 labeled GEAR EDGE permits the system to guide the web solely on the basis of its position relative to the optical sensor along its gear edge. Depression of the pushbutton 204 labeled OPER. EDGE creates a condition in which the web is guided solely on the basis of its position relative to the optical sensor along the edge closest to the operator. Finally, the button designated CENTER, when depressed, places the system in a submode in which both the gear edge and operator edge optical sensors are utilized in controlling the centering of the web between those sensors.

As an additional feature of the present invention, the operator is provided with control over the scanner position during the AUTO mode through the same pair of pushbuttons 230 and 232 used during the MANUAL mode for controlling the tilt mechanism. Depression of the button 230 adjusts the scanner heads toward the operator side of the web while depression of the pushbutton 232 shifts the scanner heads toward the gear side of the web. During positioning of the web in the AUTO mode a visual indication of operation in this mode is provided by a light 234 designated AUTO-WEB POSITION on the face of the control panel 62.

As will be described more fully below, a similar set of manual positioning buttons is provided in a remote control box that effectively operates in parallel with the switches 230 and 232 in controlling the tilt mechanism during the MANUAL mode and the scanners during the AUTO mode.

Additional operational indicators are provided on the control panel. A pair of lights 240 and 242 signal the operator whenever the web tilt mechanism is actively correcting the position of the web, the right indicator 242 indicating correction toward the gear side of the web and the left indicator 240 indicating correction toward the operator side of the web. Another set of lights 246 and 244, designated TILT MECH. LIMIT, alert the operator that the tilt mechanism has reached its limit toward either the operator or gear side of the web, respectively, and that further correction by the tilt mechanism is not possible. As will be described in more detail below, energization of either of the lights 244 or 246 will normally signal that the paper rack should be repositioned so that the system can operate within its proper limits in correcting the web position.

One final set of indicators, designated 248 and 250, are provided on the control panel to advise the operator of the condition of the optical sensing system. To this end, the light 250 is illuminated whenever the optical system on the operator side scanner fails to function properly, while the light 248 illuminates whenever the optical sensor on the gear side of the web fails to function properly. Detection of either of these conditions automatically transfers the system to the MANUAL mode as will be described more fully below.

Finally, the system provides the operator with a continual display of deviation from the center position during the AUTO and MANUAL modes on a numerical readout 252 located in the upper left hand corner of the control panel 62 shown in FIG. 6. The readout displays a positive number in either inches or millimeters as the web shifts toward the operator side of the mechanism and a negative number as the web shifts toward the gear side of the mechanism.

Thus it is seen that the control panel and its various button selectors and indicators give the operator complete control over all functions of the system and allows him to readily monitor the system's normal performance as well as failures of its various components.

AUTOMATIC SENSING DISPLAY and CORRECTION CIRCUITS

Turning now to the control circuits, FIG. 7(*a*) depicts the automatic position sensing, display and correction circuits. For the purpose of detecting the relative position of the web edges, a pair of optical scanner channels 260 and 261 are provided. The channel 260 functions as the Operator Edge Detector Channel, whereas the channel 261 functions as the Gear Edge Detector Channel. These two channels are essentially identical to each other and function to develop a signal which varies with the position of the web edge. The respective output signals from the two circuits are combined in a comparator circuit 264 which produces an output signal at a terminal 265 which varies in magnitude and polarity with the deviation of the moving web from a predetermined center position.

Turning first to the Operator Edge Detector Channel 260, there is shown an infrared emitting diode and detector circuit 263 consisting of an infrared emitting diode 266 which produces radiation in the infrared region and a phototransistor 267 which is selected to be particularly sensitive to the infrared spectrum. Between the emitter diode 266 and the phototransistor 267 are the expander optics shown in FIGS. 4(*a*), 4(*b*) and 5 for monitoring the web edge position. The diode 266 is in series with a potentiometer 262 which controls the current through, and hence the intensity of, the infrared emission from the diode 266. Also in series with the diode 266 and potentiometer 262 is a resistor 268 which completes the circuit between the positive supply terminal and ground for the diode 266. The phototransistor 267 is connected in series with a voltage dropping resistor 269 between the positive supply terminal and ground. The emitting diode 266 and phototransistor 267 are located in opposite arms of the C-shaped optical scanning head shown in FIGS. 4(*a*) and 4(*b*) and more fully described above.

As noted above, means are provided for giving a visual indication of emitter failure to the operator. To this end, the operator edge detector channel includes a transistor 270 which detects current flow through the infrared emitting diode 266. The transistor 270 has a base bias circuit consisting of series resistors 271 and 272 providing a voltage division network between the positive supply terminal and ground. A collector dropping resistor 273 creates a voltage swing at an output line 274 from the collector of the transistor 270 whenever the transistor 270 is biased into conduction. This occurs when current ceases to pass through the infrared emitter diode 266 such that all current passing through the resistor 268 must also pass through the transistor 270. The output signal from the line 274 controls operation of the operator scan failure light 250 on the face of the control panel through a drive circuit shown in FIG. 7(*c*) and described below.

In similar fashion the Gear Edge Detector Channel 261 includes an infrared emitter diode 280 connected in series with a potentiometer 281 and a dropping resistor 282 between the positive supply terminal and ground. Radiation from the diode 280, after passing through expander optics like those shown in FIGS. 4(*b*) and 5 is detected by a phototransistor 284 which is adapted to be sensitive to radiation transmitted in the infrared range of the spectrum. The transistor 284 has its emitter coupled to ground through a dropping resistor 285, while its collector is connected to the positive supply. The diode 280 and phototransistor 284 are located in opposite arms of the C-shaped scan head on the side of the web opposite the operator, called the gear edge of the web throughout this specification. As in the Operator Edge Detector Channel 260, the Gear Edge Detector Channel 261 includes a failure sensing circuit including a transistor 286 with a voltage dividing base biasing circuit consisting of resistors 287 and 288 coupled between the positive supply and ground. The output voltage from the failure circuit is provided on a collector output line 289 which varies in voltage with the current passing through a dropping resistor 290 coupled between the positive supply and the collector of the transistor 286. The signal on the output line 289 controls the illumination of the gear scan failure indicator lamp 248 on the face of the control panel, as shown and described more fully in connection with FIG. 7(*c*) below. The outputs from the phototransistors 267 and 284 are taken from their respective emitters at terminals 295 and 296.

Figure 8:
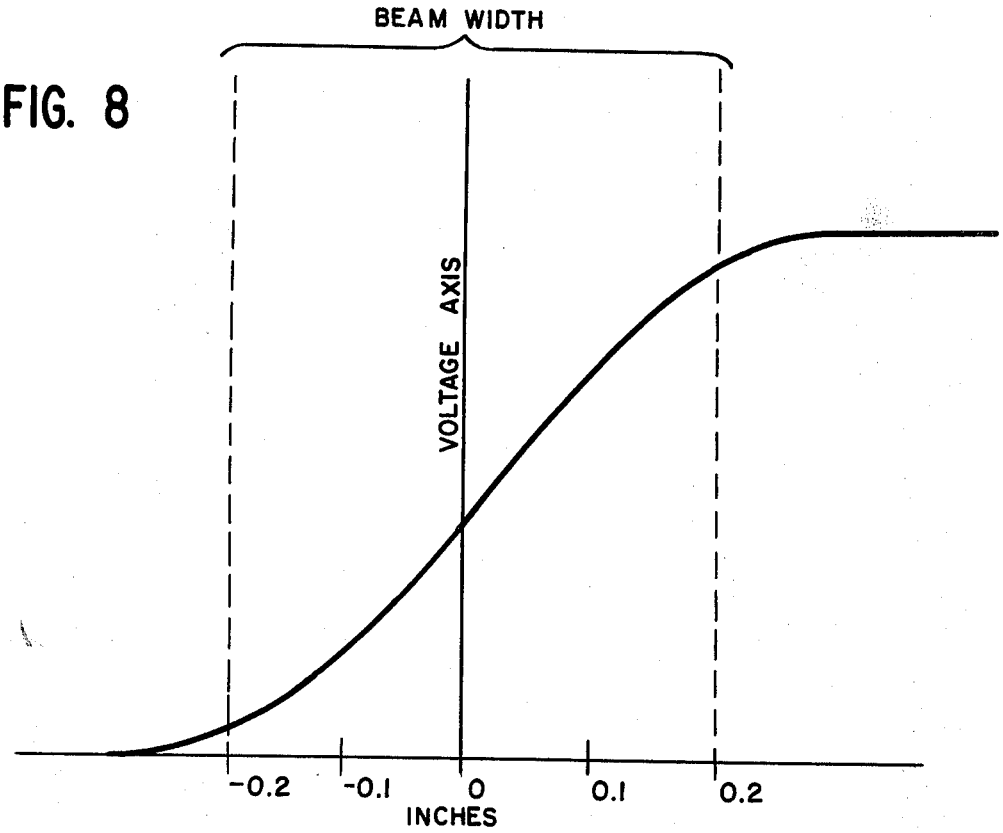
FIG. 8 is a diagrammatic representation of the unsaturated operational range of the phototransistor embodied in the scanner shown in FIGS. 4(*a*), 4(*b*) and 5.

In accordance with an important feature of the present invention, the phototransistors 267 and 284 are chosen, as noted above, to be particularly sensitive to infrared radiation, while being insensitive to light in other ranges of the spectrum and in particular to light created by fluorescent fixtures that may be present in the vicinity of the web guide apparatus. The diagram of FIG. 8 depicts the manner in which current flow through the phototransistors 267 and 284 varies with movement of the web edge across the infrared beam created by the emitter 266 or 280. Bias is established such that the output of the transistor varies in a linear fashion in its unsaturated operating region as the web edge moves from one side of the channel to the other.

The comparator circuit 264 shown on FIG. 7(*a*) compares the output signals from the operator edge and gear edge detector channels 260 and 261 to provide an output signal on the terminal 265 which varies in polarity and magnitude with deviation of the web edge from its desired center line. To this end, the comparator circuit 264 includes an operational amplifier 300 connected to operate in a differential mode. The inverting input terminal 301 of the operational amplifier 300 is driven from the output terminal 295 of the Operator Edge Detector Channel through a normally closed relay contact 302 of a relay designated CR2 and a series resistor 303. The operational amplifier 300 also has a non-inverting input terminal 306 which receives the output signal appearing on the terminal 296 from the Gear Edge Detector Channel 261 through a normally closed contact 308 of a relay designated CR1 and a series resistor 309. A feedback capacitor 310 is provided between the output terminal 265 from the operational amplifier 300 and its inverting input terminal 301 for the purpose of filtering out high frequency transient signals or spikes that might otherwise pass through the amplifier 300. In accordance with another aspect of the present invention, means are provided for scaling the deviation of the web to be read out in either inches or millimeters. To this end, gain of the amplifier 300 is controlled by one or the other of a pair of feedback resistors 312 and 313 selectively controlled by a switch 315 and disposed between the output terminal 265 and the inverting input 301 of the operational amplifier 300. The non-inverting input terminal 306 is similarly controlled through provision of a pair of resistors 318 and 319 selectively chosen by a switch 320 to be coupled between the non-inverting input terminal 306 of the amplifier 300 and ground. The switches 315 and 320 are ganged together and provide the operator with the option of having a visual readout of web deviation in inches or millimeters, depending upon the position of the switches 315 and 320.

The output 265 from the comparator circuit 264 is clamped to ground potential through a pair of series connected back-to-back zener diodes 330 and 331 respectively. The diodes 330 and 331 are solely for the purpose of controlling the voltage swing at the terminal 265 to within plus or minus 3.4 volts such that it stays within the permissible range, typically plus or minus 5 volts, of the display and correction logic circuits to be described below.

As thus far described, the edge detector and comparator circuits operate in a differential manner to signal deviation of the web position from a desired central path. Assuming the CENTER submode has been chosen by depression of the pushbutton 202 by the operator, as the web deviates, conduction through one of the phototransistors 267 or 284 increases while conduction through the other phototransistor decreases in a corresponding manner. This deviation results in imbalance of the inputs to the operational amplifier 300 which creates a variation at the output terminal 265 which corresponds in magnitude and polarity to the web deviation.

The relays CR1 and CR2 located at the outputs in the Gear Edge Detector Channel 261 and Operator Edge Detector Channel, respectively, are activated alternatively in response to depression of either the GEAR EDGE button 200 or OPER. EDGE button 204 on the face of the control panel, as disclosed more fully in connection with the circuit of FIG. 7(*b*) below. Depression of the OPER. EDGE pushbutton 204, for example, energizes the relay CR1, opening the contacts 308 and simultaneously closing a contact pair 335 which connects the input circuit for the non-inverting input terminal 306 of the operational amplifier 300 to a fixed potential established by a voltage dividing network consisting of resistors 336 and 337 connected in series between the positive supply and ground. In this manner, the relay CR1 effectively isolates the comparator 264 from the gear edge detector channel 261 and allows the operator edge detector channel 260 to take over sole control of the web positioning function. The relay CR2 provides a similar function in response to depression of the GEAR EDGE pushbutton 200 on the face of the control panel such that control of the web position is determined solely by the gear edge optical scanner.

Since only one of the inputs to the operational amplifier 300 will be varying during either the GEAR EDGE or OPER. EDGE modes, it is necessary to double the gain of the amplifier in response to varying input voltages during operation in either of these modes. For this purpose, the inverting and non-inverting input networks for the amplifier 300 include a pair of input scaling resistors 338 and 339 connected in parallel with the input resistors 303 and 309 by a center mode analog switch described below in connection with FIG. 7(*b*). The center mode switch controls a pair of contact arms 340 and 342 respectively located in series with the scaling resistors 338 and 339. During the CENTER mode the input resistance to each of the input terminals of the amplifier 300, therefore, is effectively doubled by opening of the contacts 340 and 342 so that the voltage output at the terminal 265 in response to a given deviation of the web is the same as would be experienced for the same deviation of the web when the system is either the GEAR EDGE or OPER. EDGE modes.

For the purpose of providing a visual indication of web position relative to the desired path, a display module 350 is shown in the circuit of FIG. 7(*a*) as being coupled to receive the signal from the output terminal 265 of the comparator circuit 264. The display module 350 drives the output position indicator 252 shown on the face of the control panel and may include any of a variety of commercially available display devices capable of producing a positive or negative numerical readout in response to a varying analog voltage applied at its input. One combination found suitable for this purpose includes an LED readout device controlled by an analog-to-digital converter and drive mechanism model number ICL7107 manufactured by Intersil.

In addition to providing for display of web deviation from a desired center path, the system of the present invention provides for automatic correction of the web path to reduce the deviation from the center path during operation in the AUTO mode, as selected by depression of the pushbutton 214 on the control panel. To this end, the circuits shown in FIG. 7(*a*) include a Trigger Phasing Circuit and Pulse Width Modulator 370 for developing on a pair of output terminals 372 and 374 pulse trains in phase with the positive and negative half cycles of the power supply voltage, respectively. The pulse width of the signals on the terminals 372 and 374 varies so as to control the firing angle or duty cycle of the SCR tilt motor drive shown in FIG. 7(*e*) in accordance with the magnitude of web deviation from the desired center line.

The circuit 370 includes a pair of operational amplifiers 376 and 378 which, together with appropriate steering circuits are effective to convert the bipolar deviation signal present on the output terminal 265 of the comparator 264 into a unipolar signal at the output 380 of the amplifier 378 which varies linearly with the absolute value of the comparator output signal. For this purpose, the operational amplifier 376 receives the comparator output signal at its non-inverting input terminal 381, its inverting input terminal 382 being referenced to ground through a resistor 383. The second operational amplifier 378 receives the output from the amplifier 376 at its non-inverting input terminal 385 through a forward conducting diode 386. A resistor 387 references the non-inverting input terminal 385 to ground potential. The inverting input 389 of the amplifier 378 is established at a reference potential by a series network which consists of the aforesaid resistor 383, a fixed resistor 390, a fixed resistor 391 and a potentiometer 392. The other side of the potentiometer 392 is coupled to the output terminal 380 of the amplifier 378 and forms part of the feedback path therefor. A negative swing steering diode 394 is coupled between the output of the amplifier 376 and the input resistor 390 for the inverting input terminal 389 of the amplifier 378. As thus constructed, positive swings of the signal from the comparator 264 pass directly through the amplifier 376 and the steering diode 386 to the non-inverting input terminal 385 of the amplifier 378 to thereby create a corresponding positive voltage swing at the output terminal 380. By contrast, a negative swing of the output signal from the comparator 264 creates a negative potential at the output of the amplifier 376 which is effectively ignored by the steering diode 386 while being coupled through the steering diode 394 to the inverting input terminal 389 of the amplifier 378 through the input resistor 390. As such, the negative input to the phasing circuit 370 creates a positive swing at the output terminal 380 with the same gain factor as displayed by the positive-going input signal.

The unipolar signal developed at the output 380 of the operational amplifier 378 is coupled to the inverting input terminals 398 and 400 of a pair of operational amplifiers 402 and 404 respectively. The amplifiers 402 and 404 are used in an open loop or infinite gain mode and, as such, their outputs are driven to near the positive supply potential in a step-function fashion whenever the input signals at their non-inverting input terminals 408 and 410 respectively exceed the DC level of the unipolar signal at the terminal 380. The output terminal 372 from the amplifier 402 is referenced to ground through a resistor 412, while the output terminal 374 from the amplifier 404 is similarly referenced to ground through a resistor 414. Since the purpose of the amplifier 402 is to control the operation of the tilt motor in one direction during positive half cycles of the AC line voltage, the non-inverting input terminal 408 receives a halfwave rectified signal on input terminal 420 which is coupled to one side of the input transformer of the power supply circuit shown in FIG. 7(*d*). The output signal at the terminal 372, shown adjacent thereto, therefore is in the form of a pulse which begins as soon as the positive supply voltage exceeds the unipolar reference voltage R at the output 380 of the amplifier 378. The pulse ends as the AC input voltage falls below the reference voltage R.

The lower channel operational amplifier 404 operates in a similar manner upon the halfwave rectified negative half cycle of the supply voltage appearing at an input terminal 422 connected to the opposite side of the power supply input winding shown in FIG. 7(*d*). The output signal at the terminal 374, shown immediately thereabove, therefore is identical to that appearing at terminal 372 but shifted in phase by 180 degrees. These pulse width modulated signals at the terminals 372 and 374 are selectively gated to the tilt motor control mechanism to control the SCR firing angles for the tilt motor windings as described below.

Operating in conjunction with the phasing circuit and pulse-width modulator 370 is a Correction Direction Control Circuit 430 also shown in FIG. 7(*a*). This circuit includes a pair of operational amplifiers 432 and 434 connected to receive the output signal from the comparator 264 in an inverting mode and non-inverting mode respectively. Both amplifiers are biased in an open loop or high gain configuration. The amplifier 432 has an output terminal 436 which goes sharply to its maximum positive potential whenever the output of the comparator 264 falls below the negative reference voltage established at the non-inverting input terminal of the amplifier 432. Similarly, the voltage in an output terminal 438 of the lower operational amplifier 434 rises sharply to its maximum positive potential whenever the output from the comparator 264 exceeds a positive reference potential established at the inverting input of the amplifier 434. The negative and positive reference potentials for the amplifiers 432 and 434 respectively are controlled by a pair of networks 440 and 442, each of which consists of a voltage divider operating between the positive and negative supply potentials. The network 440 includes fixed resistors 443 and 444 on either side of a potentiometer 445, the potentiometer being adjusted so that the reference potential for the non-inverting input of the amplifier 432 is slightly negative. The network 442 consists of fixed resistors 447 and 448 on either side of a potentiometer 449, the potentiometer 449 being adjusted such that the reference potential at the inverting input terminal of the amplifier 434 is slightly positive. The networks 440 and 442, as thus constructed and adjusted, define a dead band of voltage levels on either side of the zero potential level. Input voltages from the comparator 264 falling within this dead band produce no output signal on the output terminals 436 or 438. Since the signals on the output 436 and 438 are the command signals for driving the tilt motor in either direction during the AUTO mode, it should be apparent that no correction of web position will take place so long as the voltage at the output of the comparator 264 is within the dead band established by the networks 440 and 442.

The operator and gear side phasing signals appearing on the outputs 372 and 374 of the phasing circuit 370 in FIG. 7(*a*), together with the operator and gear directional signals from the outputs 436 and 438 of the directional control circuit 430 control the tilt motor through a circuit entitled TILT MOTOR DRIVE LOGIC shown in FIG. 7(*c*) and a circuit labeled TILT MOTOR SWITCHING CKT shown in FIG. 7(*e*).

Turning first to the TILT MOTOR DRIVE LOGIC shown in FIG. 7(*c*), a pair of input AND gates 460 and 461 are provided to signal the tilt motor to shift the web toward the operator and gear sides, respectively, of the guide mechanism. Each of the gates 460 and 461 has a first input connected to the AUTO mode enabling signal appearing on line 462. A pair of normally open contacts 464 of a press interlock relay CR3 are closed during normal operation of the system in the AUTO mode as described below. The AND gate 460 additionally receives inputs from the output line 372 of the phasing circuit 370 and from the output line 436 of the direction control circuit 430 shown in FIG. 7(*a*). Similarly, the AND gate 461 is activated when a correction of the web position toward the gear side of the press is called for during the AUTO mode. To this end, the AND gate 461 has, in addition to the AUTO ENABLE input on line 462, a pair of inputs respectively connected to the outputs 374 and 438 of the phasing circuit 374 and directional control circuit 430 shown in FIG. 7(*a*).

The output of the AND gate 460 provides one input to an OR gate 470, the other inputs of the gate 470 being provided for actuation of the tilt motor during the AUTO CENTER and MANUAL modes as described below. The output of the gate 470 is coupled to one input of a NAND gate 472 which forms one side of a flip-flop circuit 471 which serves the purpose of ensuring that the tilt motor is commanded to operate in only one direction at a time. The output of the gate 472 is coupled through the normally closed contacts of a limit switch 473 which is provided for the purpose of disengaging the motor drive when the web has reached the limits of its travel toward the operator side of the press. From the limit switch 473 the output of the gate 472 is coupled through a resistor 474 to a light emitting diode 475 referenced to the positive supply. The diode 475 is part of an optical isolator device used to isolate the low power logic circuits of FIG. 7(*c*) from the high power motor control circuits shown in FIG. 7(*e*).

Turning then to the remainder of the motor control circuit path shown in FIG. 7(*e*), the light output from the diode 475 is received by a phototransistor 476 having its collector coupled to the positive supply and its emitter coupled to ground through a dropping resistor 477. The output of the transistor 477 is taken from the emitter and coupled to the gate terminal of an SCR 478 which controls current flow through the tilt motor 480 in a direction which causes the tilt mechanism to shift the web toward the operator.

For the purpose of shifting the web in the opposite direction, or toward the gear side of the system, a similar channel is provided beginning with the AND gate 461 in the tilt motor drive logic of FIG. 7(*c*). In addition to the AUTO ENABLE signal on the input lead 462, the AND gate 461 has inputs for receiving the gear phasing output signal on the line 374 and the gear directional command from the output line 438 of the circuits shown on FIG. 7(*a*). The output of the gate 461 passes to one input of an OR gate 485, the other inputs for the OR gate 485 being provided for the MANUAL and AUTO CENTER modes as described below. The output from the OR gate 485 goes to a second NAND gate 486 in the flip-flop circuit 471. From the NAND gate 486, the signal passes through the normally closed contacts of a limit switch 487 which deactivates the gear side drive logic when the web has shifted beyond a predetermined limit toward the gear side of the press. With the switch 487 in its normally closed position, the output from the gate 486 of the flip-flop 471 controls the current through a dropping resistor 488 and a light emitting diode 490 connected in series with the positive supply. The diode 490, like the diode 475, is part of an optical isolator device which also includes a corresponding phototransistor 492 in the tilt motor switching circuit shown on FIG. 7(*e*). The phototransistor 492 has its collector coupled to the positive supply, while its emitter is tied to ground through a dropping resistor 493. The output from the transistor 492 is taken from the emitter and coupled to the gate of an SCR 494 which controls a series current path through a rectifier 495, the tilt motor 480 and the 115 volt AC supply 496.

The energization for the field windings of the tilt motor is a 115 volt DC signal provided by an AC to DC converter 497 which in turn is energized from the AC supply 496 as shown. As thus constructed, the tilt motor switching circuit operates to control the current through the tilt motor 480 in either of two directions. During correction toward the operator side of the press, the phototransistor 476 is energized to trigger the SCR 478 and close a series current path from the 115 volt AC supply 496 through the tilt motor 480, the SCR 478, the diode 498 and back to the other side of the AC supply. As shown, closure of this path permits current to flow only in one direction as shown by the arrow adjacent the SCR 478, and hence the tilt motor 480 can only be energized by the SCR 478 during positive half cycles of the AC supply 496. Of course, it will be recalled that the output pulse train on the line 372 of the phasing circuit 370 shown on FIG. 7(*a*) is correspondingly timed to occur only during a portion of the positive half cycle of the AC input wave such that the phototransistor 476 and its associated SCR 478 are pulsed in a similar manner to be operative only during the positive half cycle.

The gear side correction channel is similarly designed to ensure that the current through the tilt motor 480 occurs only during a predetermined portion of each negative half cycle, the current direction being controlled by the SCR 494 in accordance with the arrow immediately adjacent thereto. Thus it is seen that the direction of operation of the tilt motor 480 depends upon which of the outputs 436 or 438 from the correction direction control circuit 430 of FIG. 7(*a*) is activated. The speed of the motor 480 is proportional to the pulse width or duty cycle of its drive current, which in turn is determined by the width of the pulses from the operative output 372 or 374 of the phasing circuit and pulse-width modulator 370 shown in FIG. 7(*a*).

Briefly summarizing the system operation in the AUTO mode just described, it is noted that the operator may choose to have the web guided by the gear edge photodetector, the operating edge photodetector, or both, depending on whether he actuates the pushbutton 200, the pushbotton 204 or the bushbutton 202, respectively. Guidance only in accordance with the operator edge sensor results in opening of the contacts 308 of the relay CR1 in the gear edge channel detector and the clamping of the non-inverting input 306 of the comparator amplifier 300 to a fixed reference potential by closure of the contacts 335 of the relay CR1. The Operator Edge Detector Channel 260 thereafter is in complete control of the web. The opposite is true if the Gear Edge Detector Channel 261 is selected by depression of the pushbutton 200 on the face panel (FIG. 6). In either of these two submodes, as well as in the CENTER submode selected by depression of the pushbutton 202, the output of the comparator 264 on the terminal 265 varies in amplitude and polarity with the magnitude and direction of web deviation from the desired path. Assuming that the magnitude of the error is outside of the dead band established by the networks 440 and 442, one or the other of the direction control circuit outputs 436 or 438 is activated, depending upon whether the web is toward the gear side or the operator side of the desired path. Regardless of the direction of deviation, the phasing and pulse-width modulator circuit 370 produces an output pulse train on the outputs 372 and 374 which are separated in phase by 180 degrees but which have identical pulse widths which correspond to the magnitude of the web deviation. Of course, the deviation is simultaneously displayed on the output indicators 252 of the control panel shown in FIG. 6. Depending again upon the direction of deviation, the direction control circuit 430 of FIG. 7(*a*) activates one or the other of the AND gates 460 or 461 to cause the tilt motor 480 to shift the web either toward the operator side or the gear side in the manner heretofore described.

MANUAL WEB CONTROL

The operator often finds it desirable to manually control the web path for special printing purposes. The control system of the present invention allows the operator to take over manual control either from the control panel buttons 230 and 232 shown in FIG. 6 or from a pair of remote control pushbuttons (not shown) which may be a part of a handheld portable actuator. In either instance, the operator is provided with a continual indication of web position on the display indicators 252 of the control panel shown in FIG. 6 and FIG. 7(*a*). The manual and remote control buttons are shown on the right hand side of FIG. 7(*b*), while the circuits for the manual mode are shown in FIGS. 7(*c*) and 7(*e*). The mode selection latches and switches shown in FIG. 7(*b*) will be described later.

At the outset, it is noted again that the manual control pushbuttons 230 and 232 are actually available for control for the system in two separate modes. In the MANUAL mode these buttons control operation of the tilt motor 480, while in the AUTO mode these same buttons control positioning of the scanner motor and hence the position of the optical sensors relative to the web edges. In the latter instance, the operator can use the buttons 230 and 232 to physically shift the reference for the automatic control system described above, which is also the reference for the guiding accuracy indicators 252 on the control panel. In the MANUAL mode, on the other hand, the optical scanners remain fixed and the tilt motor 480 is driven full speed in the direction selected by the buttons 230 and 232.

Turning first to the pushbutton circuit shown in FIG. 7(*b*), therefore, the pushbutton switches 230 and 232 are part of a manual control circuit 510 and are selectively effective to connect the positive supply voltage from an input line 511 to either of two output lines 512 or 513 designated, respectively, MAN. OPER. and MAN. GEAR. The output line 512 is referenced to ground through a dropping resistor 514, while the output line 513 is referenced to ground through a resistor 515. Remote control of the functions normally provided by the pushbuttons 230 and 232 is provided by a pair of pushbutton switches 517 and 518 which parallel, respectively, the switches 230 and 232.

Moving to FIG. 7(*c*), the pushbutton output signal on the line 512 is coupled to one input of an AND gate 520, the other input to gate 520 being connected to receive the AUTO ENABLE signal on line 462 indicating that the system is in the AUTO mode. Similarly, the pushbutton output signal on the line 513 is coupled to one input of an AND gate 521, the other input of which is also connected to receive the AUTO ENABLE signal on the line 462 during the AUTO mode. The output from the gate 520 provides one input to an OR gate 523 which, in turn, drives one input of a NAND gate 524 which constitutes one half of a flip-flop 525 in the Scan Motor Drive Logic. The other input to the OR gate 523 is used during the auto centering mode as described below. The output from the gate 524 controls a light emitting diode 526 through a series resistor 527. The diode 526 is part of an optical isolation device which also includes a phototransistor 528 in the scan motor switching circuit of FIG. 7(*e*).

The scan motor switching circuit shown in the upper half of FIG.7(*e*) controls a motor 530 for repositioning the optical scan heads in a manner similar to the manner in which the tilt motor 480 is controlled in the tilt motor switching circuit in the lower half of FIG. 7(*e*). To this end, the phototransistor 528 has its collector coupled to the positive supply and its emitter referenced to ground through a resistor 531. The output signal from the phototransistor 528 is taken from the emitter and coupled to the gate terminal of an SCR 532 which controls current flow through the motor 530 in the direction indicated by the arrow adjacent thereto. A further diode 533 is also in the series circuit controlled by the SCR 532 and functions to channel the current from the motor 530 back to the opposite side of an isolation transformer 535 which brings power to the circuit from the 115 volt AC supply.

The circuit just described causes the scanner motor to shift the optical sensors toward the operator's side of the press. An identical circuit is provided for the purpose of manually shifting the optical scanners toward the gear side of the press. This circuit includes, in addition to the gear side pushbutton 232 shown in FIG. 7(*b*), the gate 521 shown in FIG. 7(*c*). The output from the gate 521 is connected to one input of an OR gate 540, the other input of which is provided for operation during the auto centering mode. The output from the gate 540 is coupled to one input of the other NAND gate 541 of the flip-flop circuit 525. The output of the NAND gate 541 controls the current flowing from the positive supply through a light emitting diode 542 and a series dropping resistor 543. The diode 542 is part of an optical isolator device which includes a phototransistor 545 in the Scan Motor Switching Circuit shown in FIG. 7(*e*). Like the operator side phototransistor 528, the gear side phototransistor 545 has its collector connected to the positive supply and its emitter coupled to ground through a resistor 547. The output signal from the phototransistor 545 is taken from the emitter and coupled to the gate of an SCR 548 which controls current flow through the motor 530 in the direction indicated by the arrow adjacent the SCR 548 through a circuit which includes the AC power transformer 535 and the steering diode 549. Energization of the phototransistor 528 by depression of the operator side pushbutton 230 causes current to flow in one direction through the scan motor 530 during positive half cycles of the AC input voltage, while energization of the phototransistor 545 in response to actuation of the gear side pushbutton 232 causes current flow through the motor 530 in the opposite direction during negative half cycles of the positive supply signal. In this manner the optical sensors are shifted from side to side as desired in response to the pushbuttons 230 and 232 during the AUTO mode.

Manual control of the web tilt mechanism during the MANUAL mode is effected in a similar manner. To this end, the tilt motor drive logic shown in FIG. 7(*c*) includes a pair of AND gates 555 and 556 each of which has an input connected to a line 557 which is activated during the MANUAL mode to enable the gates. The other input to the gate 555 is coupled to the output line 512 marked MAN. OPER. from the operator side pushbutton 230 on the control panel while the output from the gate 555 is coupled to an input of the OR gate 470 for effecting shifting of the web by the tilt motor 480 toward the operator side of the press in the manner previously described for the AUTO mode. The other gate 556 operates in a similar manner and has its input controlled from the output line 513 designated MAN. GEAR from the gear side pushbutton 232. The output from the gate 556 is coupled to one input of the OR gate 485 and therethrough effects a shifting of the web by the tilt motor 480 toward the gear side of the press in the manner previously described for the automatic mode. Unlike the AUTO mode, however, the output from the OR gates 470 and 485 are continuous during depression of the respective pushbuttons 230 and 232 rather than pulsed as in the AUTO mode. As such, the tilt motor 480 is driven in the selected direction at full speed when under manual control due to the fact that the selected phototransistor 476 or 492 (FIG. 7(*e*)) conducts continuously rather than in a pulsating fashion.

AUTO CENTER MODE

As noted above, the operator normally prefers to have the web aligned along a center path at the startup of press operation. For this purpose means are provided for automatically positioning the optical scanner rack assembly and the tilt mechanism to a desired central position prior to startup of the web guide. In addition, means are provided for automatically shifting the control system into the AUTO mode after centering is accomplished.

The button 212 on the control panel shown in FIG. 6 activates the AUTO CENTER mode by energizing a line 580 entitled AUTO CENTER ENABLE in FIG. 7(*c*). Interlocks and latches creating the AUTO CENTER ENABLE signal are shown in FIG. 7(*b*) and will be discussed later. For now, suffice it to note that the enabling signal on the line 580 is coupled to the normally open contact of each of four switches 582, 584, 586 and 588, the wiper arms of which are connected as inputs to the OR gates 523, 540, 470 and 485 respectively. The switches 582 and 584 are mechanical microswitches located on the frame assembly for the optical scanner heads, the switch 582 being adapted to be switched to its normally open position any time the scanner heads are shifted from their center position toward the gear side of the press. In the AUTO CENTER mode, therefore, the switch 582 provides an input to the OR gate 523 which activates the scan motor drive channel and thus the scan motor 530 itself to return the optical scanners toward the center position from the gear side of the press.

Similarly, the switch 584 closes to connect the enable signal on the line 580 to the input of the OR gate 540 whenever the scanners are displaced from their central position toward the operator side of the press. With the switch 584 activated, the output from the OR gate 540 goes high and causes the scan motor 530 to shift the scanners toward the center position from the operator side of the press. As the scan carriage reaches its central position, both of the switches 582 and 584 assume the normally closed position, disconnecting the drive signals from the OR gates 523 and 540 and causing the outputs from each of these gates to go low. This in turn causes the outputs from the flipflop 525 to go high, thereby leaving the scan motor 530 at rest. A pair of feedback lines 590 and 591 are taken from the outputs of the gates 524 and 541 to signal the latching logic (described below) that the scan motors have achieved their central position.

The switches 586 and 588 operate to center the web tilt mechanism in a similar fashion. The normally closed contacts of these switches are coupled to ground and held in the normally closed position whenever the tilt mechanism is centered. When the tilt mechanism is not in its center position, one or the other of the switches 586 or 588 is activated to couple the enable signal from the input line 580 to the corresponding OR gate 470 or 485 as the case may be. Activation of the gate 470 by closure of the switch 586 causes the tilt motor 480 to shift the web tilt mechanism until it is centered, at which time the switch 586 is deactivated to its normally closed position. Similarly the energization of the OR gate 485 by the switch 588 causes the tilt motor 480 to reposition the tilt mechanism to its center position, at which point the switch 588 is deactivated and reassumes its normally closed position. As with the scan carriage centering system, the achievement of the center position by the tilt mechanism is signaled back to the control panel by a pair of return lines 594 and 595 connected respectively to the operator and gear side motor drive channels at the outputs of the switches 473 and 487 respectively. It will be seen, therefore, that the achievement of the center position by both the scan carriage mechanism and the web tilt mechanism results in a high voltage on each of the lines 590, 591, 594 and 595 shown toward the bottom of FIG. 7(*c*), a condition which is sensed within the control panel to transfer operation of the system into the AUTO mode.

In accordance with another aspect of the present invention means are provided for alerting the operator that the automatic web tilt mechanism has traveled to its permissable limits or for preventing further correction. To this end, the pair of limit switches 473 and 487 are carried by the mechanical frame and energized as the tilt assembly reaches its maximum travel toward the operator side of the press or gear side of the press, respectively. As shown in FIG. 7(*c*), the switch 473 serves to disconnect the light emitting diode 475 from its drive gate 472 when the tilt mechanism reaches its operator side limits. Similarly, the switch 487 serves to disconnect the light emitting diode 490 from its driving gate 486 as the tilt mechanism reaches its gear side limit.

For the purpose of alerting the operator that the tilt mechanism has reached one or the other of its mechanical limits, the lights 244 and 246 are provided on the control panel shown in FIG. 6. As shown in the lower right hand corner of FIG. 7(*c*), the light 246 is a light emitting diode connected between the positive supply and a switching transistor 600 in series with a dropping resistor 601. The switching transistor 600 has its emitter referenced to ground and its base driven through a resistor 602 by the output of an AND gate 603. In order to provide a flashing indication that the tilt mechanism has reached its mechanical limit on the operator side, the AND gate 603 is provided with a pair of inputs, one of which is activated by the light switch 473 and the other of which is driven by a flasher circuit 605. A capacitor 607 and a resistor 608 are coupled between ground and the input terminal of the gate 603. Connected in this configuration, the light 246 is activated in a flashing or intermittent manner whenever the operator side limit switch 473 is tripped by the tilt mechanism.

The gear tilt mechanical limit light 244 on the control panel operates in a similar manner whenever the gear side limit switch 487 is tripped by the tilt mechanism. The light emitting diode 244 is connected between the positive supply and a control transistor 612 in series with the dropping resistor 601. For controlling current flow through the transistor 612 and thus through the light 244, the base of the transistor 612 is connected through a resistor 614 to the output of an AND gate 615. Similar to the gate 603, the inputs for the AND gates 615 are controlled, respectively, by the flasher circuit 605 and the gear side limit switch 487 in the TILT MOTOR DRIVE LOGIC. A resistor 616 and a capacitor 617 in parallel are coupled between ground and the input to the gate 615 which is driven by the limit switch 487. Connected in this manner, the gear tilt mechanical limit light 244 is caused to flash whenever the tilt mechanism trips the gear side limit switch 487.

The flasher circuit 605 consists of an operational amplifier 620 which operates as a multivibrator. To this end, the inverting input terminal of the amplifier 620 is controlled by an RC timing network consisting of a capacitor 621 running to ground and a resistor 622 connected in the feedback path between the output of the amplifier 620 and the inverting input. The non-inverting input of the amplifier 620 is connected to the junction of a pair of series resistors 623 and 624 forming a voltage dividing network between the positive supply and ground. A feedback path from the output of the amplifier 620 to the non-inverting input is provided through a resistor 625. At the output of the flasher circuit 605 is a forward conducting series diode 627 and a resistor 628 which references the amplifier output to ground potential.

For the purpose of signaling the operator that the tilt motor 480 is actively correcting the web position toward either the operator or gear side of the press, the apparatus shown in FIG. 7(*c*) includes the light emitting diodes 240 and 242 shown on the control panel of FIG. 6. The gear side mechanical correction light 242 is activated whenever the limit switch 487 is in its normally closed position and the gear side drive channel for the tilt motor 480 is operative. To this end, the output signal from the gear side control gate 486 of the flip-flop 471 is coupled through the limit switch 487 to a control circuit 634 for the light 242. The control circuit 634 includes a digital inverter 635, the output of which controls a switching transistor 636 through its base via an RC network consisting of a series resistor 637 and shunt capacitor 638. Current for the light emitting diode 242 flows from the positive supply through a dropping resistor 639. During any correction of the tilt mechanism toward the gear side of the press, the output of the gate 486 is low, resulting in a high voltage at the output of the inverter 635 which activates the transistor 636 to draw current through the light emitting diode 242 on the control panel.

The operator side mechanical correction indicator 240 on the control panel is controlled in a similar manner from the operator side of the tilt motor drive channel. To this end, the control circuit 645 controls current through the light emitting diode 240 and includes an inverter device 646 driven by the output of the NAND gate 472 through the normally closed contacts of the limit switch 473. The output from the inverter 646 drives a switching transistor 647 through an RC network consisting of a series resistor 648 and shunt capacitor 649. As thus connected, the control circuit 645 is activated whenever the output of the gear side control gate 472 is low. This condition causes the output of the inverter 646 to go high, turning on the transistor 647 and drawing current through the indicator light 240.

MODE SELECTION LOGIC AND INDICATORS

As noted above, the control panel shown in FIG. 6 provides pushbuttons for selecting the mode of operation desired by the operator as well as indicators for advising the operator when the system is operating in the selected mode. The logic circuits for controlling this system in accordance with the mode control buttons and indicators is shown in FIG. 7(*b*). To the left of this figure are the panel button circuits 660. Power for each of the mode selection pushbuttons 212, 214 and 216 is derived from the positive supply, as is the power for the submode selection buttons 200, 202 and 204.

Turning first to the mode selection switch 212, 214 and 216, it is noted that these switches are momentary in nature and pass a signal from the positive supply only when held down by the operator. In order to latch the system in the desired mode, a pair of mode latch flip-flops 662 and 664 are provided. The AUTO CENTER button 212 is connected to the set input S of the flip-flop 664, which is referenced to ground by a shunt resistor 665 associated with the AUTO CENTER button 212. The Q output of the auto center latch flip-flop 664 activates a control circuit 667 which provides current to illuminate the LED indicator 218 during the AUTO CENTER mode. The control circuit 667 includes a switching transistor 668 connected in a grounded emitter configuration and having a series base resistor 669. A collector dropping resistor 670 controls current through the LED indicator 218 together with a series resistor 671 coupled to the positive supply.

In addition to illuminating the LED indicator 218, the latch flip-flop 664 enables the tilt motor drive logic and scan motor drive logic shown in FIG. 7(*c*) via an output line 580 entitled AUTO CENTER ENABLE. The performance of this system in response to the auto center enable signal has been discussed above. In that discussion, it was noted that a completion of the automatic centering function is signaled by the appearance of a high voltage on each of the feedback lines 590, 591, 594 and 595 shown at the bottom of FIG. 7(*b*) and FIG. 7(*c*). In order to reset the AUTO CENTER mode latch flip-flop 664 upon the achievement of this condition, a pair of three input AND gates 675 and 676 are provided. While these gates are shown as two three-input gates, they effectively accomplish the function of a five-input AND gate by activating a line 678 when the Q output of the flip-flop 664 is high in voltage and each of the feedback lines 590, 591, 594 and 595 are also high, signaling the end of the auto centering function. The achievement of this condition triggers the reset input R of the flip-flop 664 and similarly energizes a NOR gate 680. Activation of the NOR gate 680 automatically switches the system from the AUTO CENTER mode to the AUTO mode. Of course, as the output of the gate 676 on the line 678 goes high at the completion of the automatic centering function, it resets the flipflop 664 such that the Q output falls to a low voltage, de-energizing the AUTO CENTER indicating LED 218 and removing the enable signal from the AUTO CENTER ENABLE line 580.

The flip-flop 662 of the mode latch flip-flops is provided for the purpose of latching the system in either the AUTO or MANUAL modes. To this end, the set input S of the flip-flop 662 is driven from the NOR gate 680 through an inverter 681. The inputs for the NOR gate 680, in addition to the signal from the line 678, include a signal provided by the AUTO mode pushbutton 214 from the positive supply. A voltage dropping resistor 682 is provided with the pushbutton 214 for referencing the logic signal for the gate 680 to ground potential. Thus the flip-flop 662 is "set" by the NOR gate 680 in response to either an automatic input from the gate 676 occurring at the end of the AUTO CENTER mode function or a manual input signaled by depression of the AUTO pushbutton 214. This causes the Q output of the flip-flop 662 to go high and the $\overline{Q}$ output to go low.

The low output from the $\overline{Q}$ terminal is the key operative signal during the AUTO mode. This signal is coupled to one input of a NOR gate 685 via a line 686, causing the output of the gate 685 to rise to a high voltage to illuminate the control panel indicators 220 and 234 through a switching circuit 687. The switching circuit 687 includes a series input resistor 688 coupled to the base of a transistor 689 biased in a grounded emitter configuration. The collector of the transistor 689 draws current through the LED indicators 220 and 234 from the positive supply through the dropping resistor 671. In addition to effecting illumination of the LED indicators 220 and 234 to signal the operator that the system is in the AUTO mode, the NOR gate 685 serves to activate the line 462 designated AUTO ENABLE at the right of FIG. 7(*b*). The signal on this line activates the scan motor drive logic and tilt motor drive logic of FIG. 7(*c*) to effect automatic control of the web position in the manner described above for the AUTO mode.

When triggered to the "reset" state, the flip-flop 662 shifts the system into the MANUAL mode. To this end, the reset input R of the flip-flop 662 is driven by an OR gate 695. The inputs to the OR gate 695 include a signal developed across the ground referencing resistor 696 by closure of the MANUAL pushbutton 216 on the control panel. The other two inputs to the OR gate 695 appear on lines 697 and 698 which are driven by the gear and operator side scan failure circuits shown in FIG. 7(*c*) and described in more detail below.

When the OR gate 695 triggers the flip-flop 662 to the "reset" state, the Q output goes low. This signal is coupled to one input of a NOR gate 700 causing the output therefrom to go high to activate the control line 557 designated MAN. ENABLE and illuminate the LED indicators 222 and 236 of the control panel through a switching circuit 701. The switching circuit 701 includes a transistor 702 having its emitter grounded and its base input coupled to receive a signal from the NOR gate 700 through a resistor 703. The collector of the transistor 702 controls current flow through the LED indicators 222 and 236 from the positive supply through the dropping resistor 671.

Therefore, during the MANUAL mode the flip-flop 662 assumes the "reset" condition and thereby performs the dual functions of illuminating the control panel lights designated MANUAL and MAN-TILT MECHANISM as well as activating the tilt motor drive logic of FIG. 7(*c*) in the manner hereinbefore described.

It is noted that the Q output from the flip-flop 664 is connected to one input of each of the NOR gates 685 and 700 so as to hold the outputs of those gates in a low or deactivated state during the AUTO CENTER mode, thereby precluding an overriding of the automatic centering apparatus until the centering function is completed.

As noted above, the AUTO mode encompasses three possible submodes for guiding the web, as selected by the GEAR EDGE button 200, the OPER. EDGE button 204 or the CENTER button 202 on the control panel. The system is latched into one of these three submodes by a pair of RS flip-flops 710 and 712 respectively. The flip-flop 710 serves to latch the system in a condition in which guidance is achieved solely by the optical scanner located along the operator edge of the web. For this reason, the set input S of the flip-flop 710 receives an input voltage developed across a dropping resistor 713 by depression of the OPER. EDGE pushbutton 204. The OPER. EDGE pushbutton 204 also supplies an input to an OR gate 715, the output of which is coupled to the reset input R of the flip-flop 712. In this manner, the circuit ensures that only one of the flip-flops 710 or 712 is "set" at any given time. The flip-flop 710 has its Q output coupled to the base of a transistor 716 which serves to illuminate the OPER. EDGE indicator light 210 and to energize the relay CR1. It will be recalled that the relay CR1 controls two sets of contacts located at the output of the Gear Edge Detector Channel 261 of FIG. 7(*a*). As noted in the discussion of FIG. 7(*a*), the energization of CR1 serves to disconnect the optical scanners on the gear edge of the web and to clamp the gear edge input channel for the comparator circuit 264 to a fixed reference potential. Monitoring of the web position in the AUTO mode is thereafter controlled solely from the operator edge optical sensors.

The flip-flop 712 performs a similar function during operation in the submode signaled by depression of the GEAR EDGE pushbutton 200. To this end, the voltage developed across a resistor 718 by depression of the GEAR EDGE pushbutton 200 is applied to the set input S of the flip-flop 712 while simultaneously being applied to one input of an OR gate 719 which resets the flip-flop 710.

When triggered to the "set" state by depression of the GEAR EDGE pushbutton 200, flip-flop 712 activates its Q output to drive a switching transistor 720. The transistor 720 has its emitter referenced to ground and its base controlled through a series resistor 721. When activated, the collector of the transistor 720 draws current to illuminate the gear edge indicator 206 and energize the relay CR2. As noted earlier, the relay CR2, when activated, disconnects the Operator Edge Detector Channel 260 from the comparator 264 and clamps the operator edge input for the comparator 264 to a fixed reference potential.

Turning now to the submode selected by the pushbutton 202 designated CENTER, it is noted that depression of this button applies a voltage developed across a resistor 723 to one input of each of the OR gates 715 and 719. This simultaneously resets both flip-flops 710 and 712 so that their Q outputs fall to a low voltage. Both of these outputs are coupled to the inputs of a NOR gate 725, allowing the output of that gate to go to a high voltage. This high voltage at the output of the gate 725 activates a switching transistor 726 through a base resistor 727. The emitter of the transistor 726 is coupled to ground, while the collector draws current through an LED indicator 208 adjacent the CENTER pushbutton 202 on the control panel. A resistor 728 limits the current through the indicator 208.

With the Q outputs from the flip-flops 710 and 712 at low potentials created by the depression of the CENTER pushbutton 202, the relays CR1 and CR2 remain deenergized so that both the gear edge and operator edge detector channels 261 and 260, respectively, (FIG. 7(*a*)) are operative to control the web position. Since both channels are operative, however, means are provided to reduce the gain on the comparator circuit 264 by one-half during operation in the CENTER submode. To this end, the output of the gate 725 is coupled to an analog switch 730 which opens the contact arms 340 and 342 located in the input circuits of the comparator 264 shown in FIG. 7(*a*). Because the resistors 303, 338, 309 and 339 in the comparator circuit are chosen to be equal in value, activation of the analog switch 730 effectively reduces the gain of the operational amplifier 300 by one-half to compensate for the fact that the inverting and non-inverting inputs 301 and 306 to the amplifier 300 vary simultaneously in opposite directions.

Briefly summarizing operation of the system in the AUTO mode, therefore, depression of the pushbutton 214 triggers the latch flip-flop 662 to its "set" condition. By virtue of the resulting low voltage on the $\overline{Q}$ output of the flip-flop 662, the NOR gate 685 is deactivated, causing its output to go high and drive the transistor 689 into conduction. Simultaneously the LED indicators 234 and 220 are illuminated and the AUTO ENABLE signal at the output 462 from the circuit of FIG. 7(*b*) is energized. Automatic control of the scan motor and tilt motor logic of FIG. 7(*c*) as well as the scan and tilt motors of FIG. 7(*e*) is thereby enabled.

Guidance of the web position will thereafter be controlled by either the gear edge optical scanner, the operator edge optical scanner or both scanners depending upon the operator's choice of pushbuttons 200, 204 or 202 respectively. Depending upon which of these submodes is chosen, one of the control panel indicators 206, 208 or 210 will be illuminated to signal to the operator the submode he has chosen. Dynamic monitoring and correction of the web position will thereafter proceed in accordance with the signals developed by one or both of the edge detector channels 260 or 261 shown in FIG. 7(*a*).

FAILURE DETECTION

As noted above, lights are provided on both the operator side and gear side scan heads to allow an operator watching the scan heads themselves to determine if the infrared emitter in that scan head is operative. The circuits for controlling these lights are labeled FAILURE DETECTION CIRCUITS and depicted in FIG. 7(*c*). As there shown, an LED indicator 750 is provided in the operator side scan head, while an LED indicator light 751 is located in the gear side scan head. The LED indicator 750 is energized by a switching transistor 752 having its base driven through a resistor 753 by an AND gate 754. In order that the indicator 750 may be illuminated at the proper time, the gate 754 has a first input coupled to the line 274 on the collector of the failure detecting transistor 270 in the Operator Edge Detector Channel 260 shown in FIG. 7(*a*). The other input to the AND gate 754 is derived from a line 756 connected to the Q output of the OPER. EDGE latch flip-flop 710. Illumination of the indicator 750 will therefore result whenever the transistor 270 shown in FIG. 7(*a*) is "off" (indicating conduction through the infrared emitter 266) and the system is being guided in the operator edge submode selected by depression of the pushbutton 204.

As an extra precaution to alert the operator of failure of the infrared emitter 266, a flashing signal is provided from the control panel indicator 250. To this end, the control panel indicator 250 is controlled by a switching transistor 758, which in turn is controlled through a resistor 759 from a three-input AND gate 760. The inputs to the AND gate 760 include the signal developed on line 756 connected to the Q output of the operator edge latch flip-flop 710 (FIG. 7(*b*) during the OPER. EDGE submode, the inversion of the signal on the line 274 from the Operator Edge Detector Channel and the output signal from the flasher circuit 605 shown at the bottom of FIG. 7(*c*). Activation of all of these lines simultaneously causes flashing of the indicator 250 to signal the operator that the operator side infrared emitter 266 is failing to operate. In addition to flashing the indicator 250, and AND gate 760 drives an output line 698 to reset the mode latch flip-flop 662 shown on FIG. 7(*b*) through the OR gate 695. By virtue of this connection the system is automatically transferred to the MANUAL mode upon failure of the infrared emitter for any reason.

Similar controls are provided for monitoring the infrared emitter on the gear side of the web. The light 751 located on the gear scan head is controlled by a transistor 765, the base of which is in turn controlled through a resistor 766 by a two-input AND gate 767. The inputs for the AND gate 767 are respectively coupled to the output line 289 of the failure detecting transistor 286 in the Gear Edge Detector Channel 261 of FIG. 7(*a*) and from the signal developed on the collector of the transistor 720 shown in FIG. 7(*b*), the latter signal being inverted by a logic inverter circuit 768. As thus connected, the indicator lamp 751 is illuminated by the AND gate 767 during the GEAR EDGE and CENTER submodes selected by the pushbuttons 200 and 202. Therefore, the indicator lamp 751 on the gear side scan head will be caused to illuminate during either of the aforesaid submodes so long as the infrared emitter 280 in the gear edge detector channel 261 (FIG. 7(*a*)) continues to operate.

Failure of the emitter 280 to operate is signaled on the control panel by the scan failure light 248. Operation of the light 248 is controlled by a switching transistor 770, the base of which is, in turn, controlled through a resistor 771 by a three input AND gate 772. To provide for flashing of the light 248, one input of the AND gate 772 is driven by the output of the flasher circuit 605 shown at the bottom of FIG. 7(*c*). Another of the inputs to the AND gate 772 is derived from the output line 289 of the emitter failure detecting transistor 286 in the gear edge detector channel 261 (FIG. 7(*a*)) which is inverted through an inverter 774. The final input for the gate 772 is provided by the output of the inverter 768, which in turn is controlled from the collector of the transistor 720 shown in FIG. 7(*b*). As such, flashing of the panel indicator 248 occurs whenever the gear side infrared emitter 280 fails while the system is operating in either the CENTER or OPER. EDGE submodes.

From the foregoing, it should be apparent that the operator is able to monitor the operation of the system fully from the control panel or by observation of the indicator lights on the scan heads. It is also noted that the output of the AND gate 772, when activated, is effective to reset the flip-flop 662 shown in FIG. 7(*b*) through a connection 697 to the OR gate 695 driving the reset input R to the flip-flop 662. In this manner, the transfer of the system to a MANUAL mode is effected automatically if the gear side infrared emitter fails.

For providing the necessary AC and DC supply signals for controlling the analog and digital circuits of the system, the power supply circuit of FIG. 7(*d*) is provided. A pair of terminals 780 and 781 receive the conventional AC line voltage of 115 volts and apply the same to one input of a stepdown transformer 782. Simultaneously, the line voltage is supplied to the primary of a transformer 783. The power supply circuit driven by the transformer 783 is provided solely for the purpose of developing a positive DC voltage, designated VI for the isolated scan motor and tilt motor switching circuits shown in FIG. 7(*e*). An isolated supply for these circuits is desirable to eliminate any possibility that the large voltage and current spikes created by the motor control circuits would be reflected back into the supply circuits for the small signal processing that is done in the remainder of the system. It is for essentially this same reason that the scan motor and tilt motor switching circuits shown in FIG. 7(*e*) are driven through the photoisolators from the motor drive logic circuits shown in FIG. 7(*c*).

Turning first to the isolated supply, therefore, it is seen that the transformer 783 has secondary windings 785 which drive a full-wave rectifier circuit 786. The output of the full-wave rectifier is filtered by a shunt capacitor 787 which reduces the ripple content of the rectifier output signal. A resistor 788 in series with the rectifier circuit 786 delivers current to a zener reference diode 790 across which the isolated supply potential +VI appears. The isolated supply voltage, in turn, is applied to the collectors of each of the transistors 528, 545, 476 and 492 in the photoisolator circuits shown in FIG. 7(*e*).

Turning now to the main power supply circuit for the remainder of the system, it is noted that the transformer 782 has a split secondary winding consisting of two halfwindings 795 and 796 on either side of a center tap 797. The full secondary voltage of the transformer 782 is applied to a full-wave rectifier circuit 800 which is typically of a bridge configuration. The rectifier circuit 800 has positive and negative output signals appearing on terminals 801 and 802 and a ground reference at a center terminal 803. The output of the terminal 801 with respect to the ground terminal 803 is a full-wave rectified positive-going signal. A pair of capacitors 804 and 805 are provided for reducing the ripple at the output 801 of the rectifier circuit 800. Similarly, a pair of capacitors 807 and 808 are connected across the negative side of the output from the rectifier circuit 800 to reduce the ripple in a similar manner.

The positive and negative filtered signals from the rectifier circuit 800 are thereafter applied to voltage regulators for the analog and digital circuits. It will be noted that most analog circuits and operational amplifiers require mid-level DC supply voltages typically in the range of plus or minus 15 volts, whereas digital integrated circuits conventionally operate on supply potentials of ±5 volts. The low voltage positive logic circuit consists of a series regulator circuit 810 which is referenced to ground potential and flanked by a pair of shunt capacitors 811 and 812 which provide additional filtering for the output signal appearing on a terminal 813. Similarly, the negative logic circuit includes a regulator 817 which is referenced to ground and flanked by a pair of capacitors 818 and 819 which provide additional filtering for the signal appearing on the output terminal 820. The positive and negative logic regulators 810 and 817 are adjusted to provide the necessary +5 volts and −5 volts on the terminals 813 and 820, respectively.

The positive supply circuit for the analog circuits includes a regulator device 825 which is referenced to ground and which nominally provides a +15 volt output in response to a higher input voltage. The output of the regulator 825 is coupled across a filtering capacitor 826 and a conventional diode 827 which prevents negative-going spikes from the positive supply appearing on an output terminal 828. Similarly, the negative supply voltage for the analog circuits is provided by a circuit which includes a negative supply regulator 830, a shunt capacitor 831 for providing additional filtering and a conventional diode 832. The diode 832 prevents positive-going spikes from appearing on the output of the negative supply regulator 830 at a terminal 834. In summary, therefore, positive and negative supply voltages for the analog to digital display circuits are provided on the terminals 813 and 820, respectively, which operate at ±5 volts, while the higher positive and negative DC supply signals for the analog and digital control circuits, which operate at ±15 volts, are provided on output lines 828 and 834, respectively.

While a particular embodiment of the present invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A position sensing mechanism for controlling the course of a continuous web of material through a press comprising a source of radiation in the infrared range, focus means for guiding said radiation into a channel having a width encompassing the range of normal web edge deviation from a desired path, and signal means spaced from said focus means for receiving said radiation and producing a continuous output signal corresponding to the magnitude of said radiation passing the edge of the continuous web as the web moves through the channel.

2. The position sensing mechanism of claim 1 in which the focus means and the signal means include cooperatively focused lenses arranged to optically scan the moving web edge with infrared radiation.

3. The position sensing mechanism of claim 1 which includes a first lens in the focus means, said first lens being arranged to form a broadened channel of infrared radiation, and a second lens in said signal means arranged to receive said broadened channel of infrared radiation.

4. The position sensing mechanism of claim 1 which includes a phototransistor disposed in the signal means arranged to operate in the infrared range to receive infrared radiation from the focus means.

5. The position sensing mechanism of claim 1 which includes a phototransistor disposed in the signal means arranged to operate in the infrared range to receive infrared radiation from the focus means while being substantially non-responsive to light outside the infrared range.

6. The position sensing mechanism of claim 1 wherein said signal means includes a phototransistor and wherein said channel of infrared radiation is directed into said phototransistor, the conduction of which varies linearly in response to the infrared radiation.

7. The position sensing mechanism of claim 5 further including motor means responsive to the output signals from the phototransistor and a tilt roller assembly continuously directed by said motor means for engaging the continuous web.

8. The position sensing mechanism of claim 1 in which the magnitude of the infrared radiation in the channel is continuously measured by said signal means.

9. The position sensing mechanism of claim 1 wherein said signal means includes an analog signal output means in which changes in magnitude of the output signal are continously manifested.

10. The position sensing mechanism of claim 1 in which changes in the magnitude of the continuous output signal are initiated in the signal means by the amount of infrared radiation emitted from the focus means toward the signal means unblocked by the edge of the web between the focus means and the signal means.

11. In a system for guiding a moving, continuous web of sheet material, the combination comprising position scanner means including at least one sensor positioned along an edge of said sheet material for producing a position error signal which varies in accordance with deviations in web travel from a predetermined path, web shifting means responsive to said position error signal for automatically correcting the deviation of said web travel in a direction which tends to eliminate said position error signal, manual control means for enabling the operator to assume manual control of said web shifting means, including means for disabling said scanner means during manual control, and failure detector means associated with said scanner means for automatically disabling said scanner means and enabling said manual control means in response to a failure of said sensor.

12. In a system for guiding a moving, continuous web of sheet material, the combination according to claim 11 wherein said sensor includes an infrared emitter and wherein said failure detector means disables said scanner means in response to a failure of said infrared emitter.

13. In a system for guiding a moving, continuous web of sheet material, the combination according to claim 11 further including a visible indicator located with said sensor along the edge of said sheet material and controlled by said failure detector means so as to be illuminated during normal operation of said sensor.

14. In a system for guiding a moving, continuous web of sheet material, the combination according to claim 11 further including a control panel remote from said sensor and including a manual actuator for said manual control means and an indicator controlled by said failure detector means for signalling the operator of a failure of said sensor.

15. In a system for guiding a moving, continuous web of sheet material, the combination comprising web shifting means operative between predetermined lateral limits for altering the web travel path, automatic position control means selectively coupled to said shifting means for monitoring the actual web position relative to a predetermined path and controlling said web shifting means to maintain the web travel along said predetermined path, manual position control means selectively coupled to said web shifting means for controlling the web travel along a manually selected path, and means associated with said web shifting means for disabling said automatic position control means and enabling said manual control means upon the attainment either of said predetermined lateral limits by said web shifting means.

16. In a system for guiding a moving, continuous web of sheet material, the combination according to claim 15 further including indicator means for signalling the operator whenever said web shifting means attains either of said predetermined limits.

17. In a system for guiding a moving, continuous web of sheet material, the combination according to claim 15 wherein said disabling means includes a limit switch physically actuated by said web shifting means.

18. In a system for guiding a moving, continuous web of sheet material, the combination comprising position scanner means operative within a predetermined lateral range and including at least one sensor positioned along an edge of said sheet material for producing a position error signal which varies in accordance with deviations in web travel from a predetermined path, web shifting means operative within a predetermined lateral range and responsive to said position error signal for automatically correcting the deviation of said web travel in a direction which tends to eliminate said position error signal, and means for automatically and initially adjusting said scanner means and said web shifting means to a location substantially corresponding to the center of their predetermined ranges prior to starting of web travel.

19. In a system for guiding a moving, continuous web of sheet material, the combination according to claim 18 further including means for disabling said automatic centering means and enabling and actuating said position scanner means when automatic centering is completed.

20. In combination, a position sensing mechanism for controlling the course of a continuous web of material through a press comprising a source of radiation in the infrared range, focus means for guiding said radiation into a channel having a width encompassing the range of normal web edge deviation from a desired path, and signal means spaced from said focus means for receiving said radiation and producing a continuous output signal corresponding to the magnitude of said radiation passing the edge of the continuous web as the web moves through the channel, and monitoring means connected to the position sensing mechanism for continuously measuring the position of the web along the desired path.

21. The combination of claim 20 in which the monitoring means includes a read-out mechanism arranged to display the amount of web edge deviation from the desired path.

22. The combination of claim 21 in which the monitoring means includes a read-out mechanism arranged to display in inches the amount of web edge deviation from the desired path.

23. The combination of claim 21 in which the monitoring means includes a read-out mechanism arranged to display metrically measured amounts of web edge deviation from the desired path.

24. The combination of claim 20 in which the monitoring means includes an analog circuit having direct response to deviations of the web from the desired path.

25. In a system for guiding a moving, continuous web of sheet material, the combination comprising a web support mechanism shiftable over a predetermined range and adapted to laterally shift the web and thereby control its path, means for controlling said web support mechanism to establish the web travel along a predetermined path, and automatic means for initially centering said web support mechanism within said predetermined range including means for disabling said controlling means until centering is achieved.

26. In a system for guiding a moving, continuous web of sheet material, the combination of claim 25 further comprising means for automatically disabling said automatic centering means and enabling said controlling means as said web support mechanism achieves said center position.

27. In a system for guiding a moving, continuous web of sheet material, the combination according to claim 25 wherein said disabling and enabling means includes at least one electromechanical switch coupled to said shiftable web support mechanism and adapted to be actuated upon the achievement of said center position by said web support mechanism.

28. In a system for guiding a moving, continuous web of sheet material, the combination comprising web shifting means operative between predetermined limits for altering the web travel path, automatic position control means selectively coupled to said shifting means for monitoring the actual web position and controlling said web shifting means to effect lateral movement of the web, said control means including at least one web position sensor disposed along the web path and adapted to signal web position within a predetermined lateral range, and means for automatically and initially adjusting said web position sensor so that said sensor signals web deviations from a position substantially in the center of said predetermined lateral web range.

29. In a system for guiding a moving, continuous web of sheet material, the combination of claim 28 further including means for automatically actuating and enabling said automatic position control means when said initial adjustment of said position sensor is complete.

30. A web control assembly for a web comprising an entrance roller, a tilt frame having a pair of tilt rollers mounted thereon, an exit roller, said web being disposed under the entrance roller, over the tilt rollers and under the exit roller, a motor means connected to the tilt frame operable to move the frame to cant the tilt rollers with respect to the longitudinal line of travel of the web, a web edge scanner adjacent at least one edge of the web, said scanner including a source of radiation in the infrared range, focus means for guiding said radiation into a channel having a width encompassing the range of normal web edge deviation from a desired path along said longitudinal line of travel, and signal means spaced from said focus means for receiving said radiation and producing a continuous output signal corresponding to the magnitude of said radiation passing the edge of the web, and means intermediate the motor means and the scanner for directing the motor means to cant and straighten the tilt frame.

31. The web control assembly of claim 30 which includes means intermediate the motor means and the scanner for directing the motor means to cant and straighten the tilt frame in response to the output signal from the scanner.

32. The web control assembly of claim 30 which includes means intermediate the motor means and the scanner for maintaining the web edge in the desired path along the longitudinal line of travel of the web.

33. The web control assembly of claim 30 which includes means intermediate the motor means and the scanner for returning the web edge to the desired path whenever the web edge is disposed within the range of normal web edge deviation from said path.

34. The web control assembly of claim 33 in which the means intermediate the motor means and the scanner includes means responsive to an output signal initiated by transmitting a quantity of infrared radiation past the web edge in the scanner for controlling the motor means.

35. The web control assembly of claim 30 including tramming means disposed in the tilt frame for adjusting the distance apart of the top surface of the exit roller from the top surface of the adjacent tilt roller for maintaining a taut web edge through the infrared radiation channel in the scanner intermediate said exit roller and said tilt roller.

36. The web control assembly of claim 35 further including an assembly edge plate on which the exit roller and the tilt frame are mounted in spaced-apart relationship, the tramming means including an adjustable member movably disposed to a preselected position in the tilt frame.

37. The web control assembly of claim 35 further including an assembly edge plate on which the exit roller and the tilt frame are mounted in spaced-apart relationship and a mounting link extending to the tilt frame from the assembly edge plate, and wherein the tramming means includes an adjustable screw member in the tilt frame movable to extend to a preselected position against said mounting link.

38. The web control assembly of claim 30 which includes a web edge scanner adjacent each edge of the web, a first one of said scanners having a focus means guiding an infrared radiation channel against a first web edge along one side of the web, and a second one of said scanners having a focus means guiding an infrared radiation channel against a second web edge opposite the first edge.

39. The web control assembly of claim 38 further including means interconnecting said first and second scanner and for positioning the scanners in unison adjacent the first and second web edges along the desired web paths through each scanner.

40. The web control assembly of claim 38 which includes means intermediate the motor means and the scanners for directing the motor means to cant and straighten the tilt frame in response to the output signals from both scanners to maintain the first and second web edges equidistant from the desired web paths through each scannner.

41. The web control assembly of claim 38 which includes means intermediate the motor means and the scanners for directing the motor means to cant and straighten the tilt frame in response to the output signals from the first one of the scanners to maintain the first web edge in the desired path through the first scanner.

42. The web control assembly of claim 38 in which the first and second scanners are interconnected by means for positioning the scanners adjacent the first and second web edges and simultaneously positioning the tilt rollers in a preselected orientation across the center of the longitudinal axis of the entrance and exit rollers.

43. In a system for guiding a moving, continuous web of sheet material, the combination comprising an AC power source, web shifting means including a pair of tilt rollers and a variable speed motor for controlling said rollers so as to effect a lateral shift in the web path, said motor having a supply winding coupled to said AC power source and a control winding for varying the direction and speed of the motor in accordance with the direction and duty cycle of a current applied thereto, and web path control means coupled to said motor control winding for controlling said motor, said path control means including a circuit for developing a train of current pulses in phase with said AC source, said current pulses varying in width and in direction in accordance with the magnitude and direction of a desired web path correction.

44. In a system for guiding a moving, continuous web of sheet material, the combination comprising an AC power source, web shifting means including at least one tilt roller and a variable speed motor for controlling said roller so as to effect a lateral shift in the web path, said motor having a first winding coupled to said AC source and a second winding which changes position relative to said first winding with rotation of said motor and is controllable for varying the direction and speed of the motor, command means for developing a command signal whose polarity corresponds to a desired direction of travel for said motor and whose magnitude corresponds to a desired speed for said motor, signal processing means coupled to said AC power source, said command means and said web shifting means for (a) developing a first pulse train in phase with the positive half cycle of said AC power source having a pulse width corresponding to the magnitude of said command signal and for applying said first pulse train to the second winding of said motor whenever said command signal is of a first polarity so as to drive said motor in one direction, the firing angle of said motor corresponding to the pulse width of said first pulse train and (b) developing a second pulse train in phase with the negative half cycle of said AC power source having a pulse width corresponding to the magnitude of said command signal and for applying said second pulse train to the second winding of said motor whenever said command signal is of the opposite polarity so as to drive said motor in the opposite direction with a firing angle corresponding to the pulse width of said second pulse train.

45. In a system for guiding a moving, continuous web of sheet material, the combination comprising an AC power source, means for laterally shifting the web in relation to its path of travel, a motor supplied by said AC power source and having at least one control winding for varying the speed and direction of said motor in accordance with the duty cycle and direction of an applied current, means for developing a command signal corresponding in magnitude and polarity to the desired speed and direction of travel for said motor, and means responsive to said command signal for developing a current pulse train on said control winding which is in phase with said AC source and which has a direction and duty cycle corresponding respectively to the polarity and magnitude of said command signal.

* * * * *